US006269145B1

(12) United States Patent
Piestrup et al.

(10) Patent No.: US 6,269,145 B1
(45) Date of Patent: Jul. 31, 2001

(54) COMPOUND REFRACTIVE LENS FOR X-RAYS

(75) Inventors: Melvin A. Piestrup, Woodside; Richard H. Pantell, Portola Valley; Jay T. Cremer, Palo Alto; Hector R. Beguiristain, Oakland, all of CA (US)

(73) Assignee: Adelphi Technology, Inc., Palo Alto, CA (US)

( * ) Notice: Subject to any disclaimer, the term of this patent is extended or adjusted under 35 U.S.C. 154(b) by 0 days.

(21) Appl. No.: 09/307,289

(22) Filed: May 7, 1999

(51) Int. Cl.[7] ..... G21K 1/06
(52) U.S. Cl. ..... 378/81; 250/505.1
(58) Field of Search ..... 378/84; 250/505.1; 359/247

(56) References Cited

U.S. PATENT DOCUMENTS 5,880,478 * 3/1999 Bishop et al. ..... 250/505.1

* cited by examiner

*Primary Examiner*—Robert H. Kim
*Assistant Examiner*—Pamela R. Hobden
(74) *Attorney, Agent, or Firm*—Joseph Smith

(57) ABSTRACT

In accordance with the present invention, a compound refractive lens for focusing, collecting and collimating x-rays comprising N individual unit lenses numbered i=1 through N, with each unit lens substantially aligned along an axis such that the i-th lens has a displacement $t_i$ orthogonal to said axis, with said axis located such that the sum of the displacements $t_i$ equals zero, and wherein each of said unit lenses comprises a lens material having a refractive index decrement less than 1 at a wavelength less than 100 Angstroms.

30 Claims, 21 Drawing Sheets

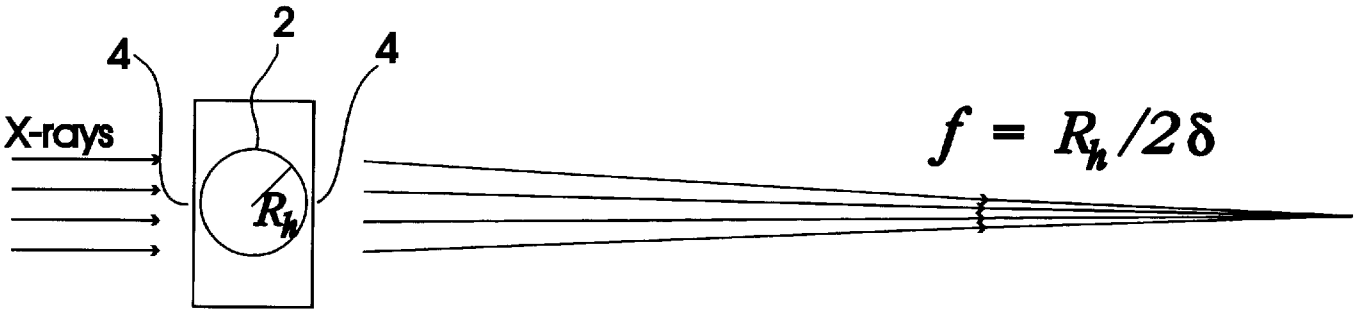
FIG. 1A, (PRIOR ART)
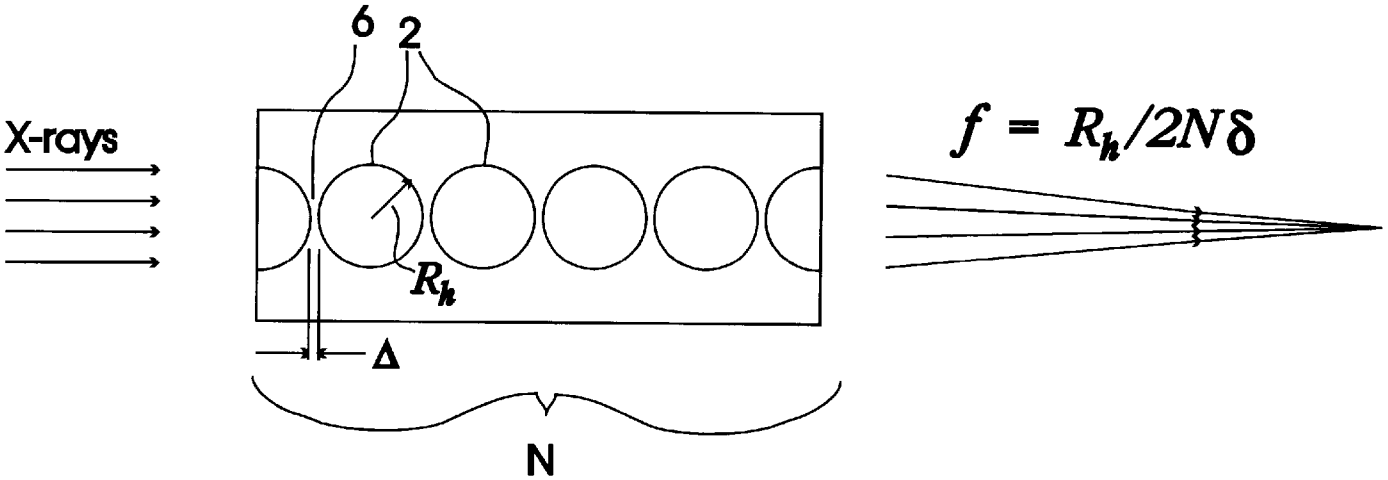
FIG. 1B, (PRIOR ART)

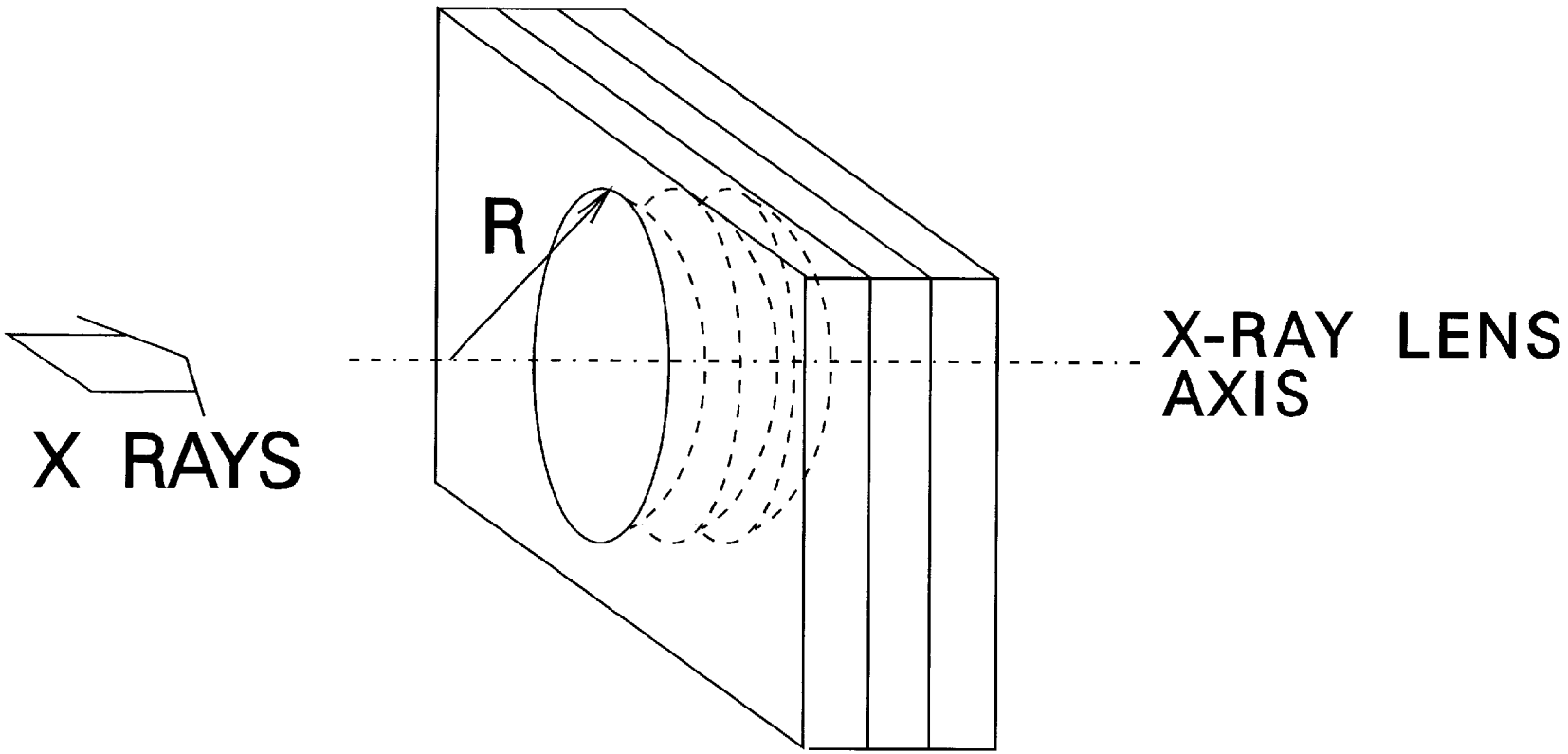
FIG. 2, (PRIOR ART)

X-ray Telescope

Optical Equivalent

COMPOUND REFRACTIVE LENS FOR X-RAYS

BACKGROUND—FIELD OF INVENTION

This invention relates to an apparatus that uses a plurality of thin lenses for the focusing, collection, collimation and general manipulation of x-rays for medical, industrial and scientific applications.

BACKGROUND—DESCRIPTION OF PRIOR ART

In the prior art the collection and focusing of x-rays has long been difficult to accomplish because x-ray reflection and refraction is limited to very small angles. Most x-ray optics use small-grazing-angle reflective surfaces that are limited to soft to moderate x-ray energies. Until recently, x-ray refractive lenses that are similar to ordinary visible-light refractive lenses, which collect, bend and focus visible photons, have not been considered to be feasible. Refraction of x-rays is difficult because the refractive index of all materials is slightly less than 1, (i.e. $(n-1)<0$ and $|n-1|<<1$) with the possible exception for photon energies near the photo-absorption shell edges of the lens substrate material, where n can be larger than 1.

Recently, renewed interest has been given to refractive x-ray lenses due to an important, but simple, idea as theorized by Toshihisa Tomie (U.S. Pat. No. , 5,594,773) and demonstrated by A. Snigirev, V. Kohn, I. Snigireva and B. Lengeler, ("A compound refractive lens for focusing high-energy X-rays, Nature 384, 49 (1996)). It has long been known for optics in the visible spectrum that a series of N closely spaced lenses, each having a focal length of $f_1$, has an overall focal length of $f_1/N$ (e.g. F. L. Pedrotti and L. Pedrotti, "Introduction to Optics," Prentice Hall, Chapt. 3. p.60, 1987). Recently, Tomie and Snigirev et al. have shown that this can also be done in the x-ray region of the spectrum using a series of holes drilled in a common substrate that effectively mimics a linear series of lenses. This "compound refractive x-ray lens" (CRL) is manufactured using N number of unit lenses, each constituted by a series of hollow cylinders or holes that are embedded inside a material capable of transmitting x-rays. Two closely spaced holes form what appears to be a concave-concave (bi-concave) lens at their closest juncture. N holes result in N unit lenses. For x rays, the index of refraction of the material is less than 1; thus, unlike optical refraction optics, which will cause visible rays to diverge, the bi-concave lens performs in opposite fashion and focuses x-ray photon energies instead.

This embodiment of the prior art of Tomie and Snigirev et al. is shown in FIG. 1A and FIG. 1B. A unit x-ray lens, shown in a top view in FIG. 1A, is made of a hollow cylinder 2 of radius $R_h$ has a focal distance, $f_1$, represented by:

$$f_1 = \frac{R_h}{2\delta} \tag{1}$$

where $R_h$ is the radius of the hole and the complex refractive index of material is expressed by $$n=1-\delta-i\beta \tag{2}$$

As shown in FIG. 1A, a single hollow cylinder 2 represents two plano-concave lenses, 4. Closely spacing a series of these holes as shown in FIG. 1B results in a focal length of:

$$f = \frac{f_1}{N} = \frac{R_h}{2N\delta} \tag{3}$$

A series of hollow cylinders 2 approximates a series of bi-concave cylindrical lenses 6. Comparing eqn. (1) and (3), the focal length, f, for the series of lenses is reduced by 1/N from that of a single lens. Thus, a single lens made of a hole in A1 with radius R=100 $\mu$m, will have a focal length of 10 meters at 30 keV, whereas, a compound refractive lens composed of 100 holes will give a 0.1 meter focal length. This is a dramatic reduction in focal length, making such a refractive lens useful.

As stated previously, utilizing multiple lenses to reduce the focal length in other parts of the electromagnetic spectrum has been well know for years and is in a standard textbook for optics (Pedrotti and Pedrotti). The Tomie patent teaches particular fabrication techniques utilizing a single material substrate with holes or spheres for all the lens elements. In the prior art of Tomie, obtaining good focusing characteristics for a series of N lenses required that the machining of the holes be "conducted at a high precision capable of keeping the geometric error within a small fraction of the value obtained by dividing the wavelength of the x rays to be focused by δ of the lens material (=λ/δ)."

Tomie suggests that arranging larger numbers of lenses in a cascading series of N individual unit lenses (not a single substrate for all lenses) stacked as shown in FIG. 2 would work to reduce the focal distance f by f/N: however, "In this configuration . . . many unit X-ray lenses have to be arranged after fabricating the individual unit X-ray lenses. The thickness of each unit x-ray lens has to be very thin to avoid strong absorption of X-rays, making each unit X-ray lens very fragile and difficult to handle. Moreover, aligning the optical axis of all units along the X-ray lens axis with high precision would be extremely difficult. Hence, arranging many X-ray lenses in the configuration shown in FIG. 1" (in the present patent: also FIG. 2) "is practically impossible." (our underline, Tomie, U.S. Pat. No. 5,594,773, coll. 4, lines 19–28).

Note in FIG. 2, the thin lenses are in contact, which presents difficulties in both support and alignment. Indeed, there is no alignment or support structure shown. To solve this problem, Tomie utilizes a single common substrate with accurately machined holes or embedded spheres which act as quasi-lenses. He teaches that thin unit lenses that do not have such a common substrate cannot be utilized for CRLs since they would be difficult to stack and align (Their thinness and fragility prevent them from being stacked and aligned). The required thicknesses of between 1 to 100 microns make them difficult to stack without damage and difficult to align.

In the prior art, accuracy of the lenses' dimensions, alignment and spacing is achieved by utilizing a single substrate material with holes drilled by conventional means such as computer-driven machine drilling or laser drilling. Such drilling methods make it difficult to achieve lens thicknesses (e.g. spacing between holes, Δ, as shown in FIG. 1B) of less than 25 microns, i.e. such spacing limits the minimum thickness of each individual lens component to 25 microns. Conventional machine drilling methods for hole spacing less than this will result in the drill breaking through the wall between holes. Conventional laser drilling techniques will result in tapered walls. Wall thicknesses of 25 microns or larger result in large absorption of x rays in a compound refractive lens of even a few single elements for x-ray energies below 4 keV. As stated by P. Elleaume, the Tomie lens design's "drawbacks are their limitation to high photon energies above 4 keV due to absorption, their strong chromatic aberrations and low aperture." (P. Elleaume, "Two-Plane Focusing of 30 keV Undulator Radiation with a Refractive Lens." pp. 33–35 in Research & Development, ESRF).

Tomie also pointed out that rather than cylindrical or spherical shapes, a material having a concave shape of a paraboloid of revolution is theoretically ideal as an x-ray lens. As stated in the above quote from Elleaume, it is well known that cylindrical and spherical surfaces will give strong chromatic and spherical aberrations. An ideal surface would be parabolic in shape. Such a shape is impossible to obtain using conventional machine drill techniques. In the prior art, only machine drill techniques have been utilized to achieve the Tomie design. (P. Elleaume, and Snigirev et al. papers cited above). He also points out in his invention that the extent to which the focal length can be shortened by reducing the radius of the cylinder or sphere has limits due to fabrication techniques, and absorption in the lens material. Hence, "the focal length f remains quite long even after maximum practical reduction."

Another problem with the simple Tomie configuration, as stated by P. Elleaume in the above quote, is that that the aperture of the lens array is limited. Snigirev has shown that the holes only approximate a lens. This is due to absorption at the edges of the lens and the fact that the lens shape is not parabolic. These effects make the compound refractive lens act like an iris as well as a lens. To first approximation, the radius of the aperture of the lens is the radius of the hole, $R_h$. However, absorption suppresses the contribution of the outer part of the lens; thus the absorption aperture radius $r_a$ is given by:

$$r_a = \left(\frac{2R_h}{\mu N}\right)^{1/2}, \tag{4}$$

where $\mu$ is the linear absorption coefficient of the lens material.

If absorption is neglected, only the central part of the cylindrical hole approximates the required parabolic shape of an ideal lens. The parabolic aperture radius $r_p$ given by Snigirev to be:

$$r_p = (4R_h^2\lambda r_i)^{1/4} = \left(\frac{2R_h^3\lambda}{\delta N}\right)^{1/4} \tag{5}$$

where $r_i$ is the image distance and $\lambda$ is the x-ray wavelength. Rays outside this aperture do not focus at the same point as those inside. The second equation is approximately true if $r_o$>>f. This is usually an accurate approximation for synchrotron sources where the distance to the source, $r_o$, is quite large.

The effective aperture radius $r_e$ is the minimum of the absorption aperture radius, $r_a$, and the parabolic aperture radius, $r_p$, and the hole aperture radius $r_h$=$R_h$; that is:

$$r_e = \mathrm{MIN}(r_a, r_p, r_h). \tag{6}$$

In the prior art of Snigirev, in which cylindrical lenses have been fabricated and tested, the aperture is limited to less than 200 $\mu$m. (Snigirev et al. above).

In the prior art very low Z materials were suggested to be best for hole lenses. Be metal was suggested by Yang (B. X. Yang "Fresnel and refractive lenses for X-rays", Nuclear Instruments and Methods in Physical Research A328 pp. 578–587 (1993)) to be the best material for making lenses. Yang's paper states that the best material possesses a large $\delta/\beta$, where $\beta$ and $\delta$ are the factors in the complex dielectric constant as given by eqn. 2. This is roughly a measure of how much the material can bend x-rays over the amount of absorption. Since Be gives the largest $\delta/\beta$, it was deemed the best lens material. Unfortunately, Be is extremely difficult to utilize since it is expensive and difficult to machine, being extremely toxic if airborne during the machining process. Machining for individual Fresnel refractive lenses would also be expensive since each lens of the linear array must be individually micromachined and not easily mass-produced.

For very large photon energies (e.g. E>30 keV), the use of low density low Z materials such as Be for the manufacture of lenses becomes difficult because of the large number of lenses required for each compound refractive lens. The number of individual lenses required for such designs increases to the point where the CRL would become too long and its aspect ratio (total CRL length to aperture diameter) becomes very large. Designs for Be lenses in the 30 keV to 100 keV range show that the number of lenses would be greater than 1000 for focal lengths of less than 1 meter.

Another problem with the use of the Tomie/Snigirev CRL is that the focal length f varies dramatically with changes in x-ray photon energy (The focal length f varies as the square of the x-ray photon energy). Since the focal length f varies as equation (3) and $\delta = v_m^2/2v^2$ where v is the photon energy in keV, the focal length f varies roughly as $f = Rv^2/Nv_m^2$, where $v_m$ is plasma frequency of the lens material. Thus, the focal length f varies as the square of the photon energy. This is not ideal for many applications where one would like the focal length to be constant for a large range of x-ray photon energies. Thus there is need for a system of compound refractive lenses that is achromatic, which is not supplied by the prior art.

In the prior art of B. X. Yang "Fresnel and refractive lenses for X-rays", Nuclear Instruments and Methods in Physical Research A328 pp. 578–587 (1993), it was proposed that single Fresnel lenses in both cylindrical and spherical form were superior focusing elements for hard x-rays. Both their design and fabrication were discussed for both x-ray Fresnel zone plates and refractive Fresnel lenses. Yang suggests that only single lenses were to be used. Thus issues such as multiple lens alignment to achieve focusing, as in the art of Tomie, were not addressed.

In the prior art, it has been suggested that other shapes such as Fresnel, parabolic and spherical can be used (e.g. Robert K. Smithers, Ali M. Khounsary, and Shenglan Xu, "Potential of a Beryllium X-ray Lens, SPIE vol. 3151, p. 150, 1997). However, all have suggested that a common substrate or spit substrate (two-halves) be used. Machining difficult surfaces such as Fresnel lens in a periodic array into one substrate would be difficult. Tomie in his above cited patent has shown how to fabricate spheres in a split medium (two-halves) to from a CRL lens of many unit lenses capable of focusing in two dimensions.

In the prior art of Tomie and Snigirev, complex optical systems such as telescopes or microscopes are difficult to construct because of the unwieldy geometry of the hole and sphere designs. In addition, these lenses have other drawbacks that limit their use in complex systems. These drawbacks are small aperture size, large x-ray absorption and spherical aberration. Furthermore, optical systems of more than one element must minimize x-ray absorption in the individual elements.

In the prior art, it is difficult to achieve two-dimensional (2-D) focusing because of the difficulty of machining spheres into a single substrate. One solutions was utilized by A. Snigirev, B. Filseth, P. Elleaume, Th. Klocke, V. Kohn, B. Lengeler, I. Snigireva, A. Souvorov, J. Tümmler ("Refractive lenses for high energy X-ray focusing" SPIE vol. 3151, p. 164, 1997) in which they used two CRLs whose cylindrical axes where crossed. As in optics two crossed cylindrical lenses will focus in two dimensions. This gives added absorption since two CRLs must be used. Advanced structures such as Fresnel lens surfaces can not be easily machined.

Objects and Advantages

The preferred embodiment of the present invention provides for an array of individual thin lenses without a common substrate but with a common optical axis. The present invention provides for a means of supporting and aligning of very thin unit lenses with accuracy adequate for x-ray collecting, focusing and imaging. The present invention teaches that small random displacements of the individual lenses off a common axis will not invariably lead to the lens array failure to collect and focus x-rays. The present invention shows that the prior teachings of Tomie are incorrect concerning the difficulty of achieving collection and focusing from a linear series of individually separate refractive lenses which are slightly displaced from one another. The embodiments of the present invention provide for the adequate support of the individual unit lenses using several techniques of lens support, thus permitting the use of very thin lenses and reducing x-ray absorption.

In the present invention a small random displacement off the average axis of a linear series of lens elements which form a compound refractive lens is shown not to dramatically affect the focal spot size, focal length of the lens, and the lens aperture size. We take up these issues in the Description section.

In the present invention, separate ultra-thin lenses are possible since the lenses need not be exactly in contact. This allows the unit lenses to be individually supported by structures that are thicker than the thin lenses, such as a rigid-ring structure. The unit lenses are then separated by a gap that is equal to that of the thickness of the support structure. The addition of the gap does not affect the collection and focusing of the x-rays as long as we can assume the thin lens formula assumption is still correct ($f \gg l$), where l is the length of the CRL including the gaps between the unit lenses and f is the focal length of the CRL. The lens will still work if the CRL is thick ($f \approx l$), but the simple formula for the focal length must be modified.

The rigid support structure is also used to aid in the alignment. A support and alignment structure is shown in FIGS. 3A and 3B. FIG. 3A shows an exploded view of one embodiment in which thin Fresnel lens 42 are supported by support disks 20 and aligned by means of alignment rods 40 (e.g. dowel pins) with a support base 50. As will be discussed and shown in FIGS. 13 and 14, the support structure is used to align the unit lenses either by pins or by a ring. The thin unit lenses must be aligned relative to the support structure alignment means, which in the case of the rings could be the outside diameter of the ring; i.e. this means that the unit lens should be concentric with the ring structure.

When unit lenses are aligned using pins or screws, holes are placed in the support structure to align the lenses with the pins or screws or both. This is shown in FIG. 14. Unit lenses manufactured using compression molding techniques, where both the lens and the support structure are of the same material, are extremely uniform in their overall dimensionality and lend themselves to easy alignment using the techniques of FIGS. 13 and 14.

The present invention permits unit lenses to be individually constructed using mass production techniques (e.g. compression and injection molding). Fabrication of individual lenses before assembly into compound structures is advantageous in that it permits unusual lens shapes such as parabolic or Fresnel surfaces to be utilized. These lenses will have the benefit of larger apertures over those of unit lenses composed of holes or spheres. As we will show, unit lenses of parabolic and Fresnel shapes can be used because small random displacements off the average axis will not appreciably affect the ability of a linear series of unit refractive Fresnel lenses of common average axis to collect and focus x-rays.

In one embodiment, low-density plastics, such as polyethylene, are used as the lens substrate material. Lenses made of plastics are not as refractive or as transparent as Be; however, they are easier to safely mass produce into Fresnel and parabolic shapes. Current methods of fabricating optical (visible and infrared frequency range) Fresnel lenses are used in some embodiments of the present invention to manufacture unit x-ray Fresnel lenses for compound refractive lenses. There are mass production techniques of injection and compression molding that permit the inexpensive fabrication of Fresnel lenses. These techniques were developed for optical (visible and IR radiation) Fresnel lenses, and, as will be demonstrated, can be used for x-ray compound refractive lenses without undue requirements for accuracy of the lenses' surface features and their alignment relative to one another.

The fabrication of individual lenses permits the construction of lenses that produce diverging x-rays (convex-convex lenses, plano-convex lenses). This permits the construction of lens systems that are similar to optical systems of lenses. For example, devices such as x-ray microscopes and telescopes can be manufactured using converging and diverging lenses.

The manufacturing techniques of present invention permit the fabrication of much thinner lenses than those of the prior art of Snigeriv and Tomie. The ability to make individual lenses before stacking them permits a variety of fabrication techniques that result in thinner lenses. We have fabricated and tested CRLs composed of unit lenses whose maximum thickness was 19 $\mu$m and whose minimum thickness was 5 $\mu$m. Thinner thicknesses are possible.

Thinner lenses permit reduced x-ray absorption and, thus, permit the use of systems of compound refractive lens systems to achieve a variety of devices that now exist only in the visible spectrum. Since $\delta$ is decreasing with increasing photon energy, designs for lenses that focus harder x-rays requires larger numbers of lenses. Thinner lenses permit the focusing of harder x-rays, since the number of lenses can be increased without undue absorption. Thinner lenses permit the use of more than one compound refractive lens for the construction of achromatic lens systems, x-ray microscopes and telescopes.

In the present invention CRLs are designed for the hard x-ray region (10 keV to 100 keV) using high-density materials. CRLs are fabricated out of high Z materials so that the number of individual lenses that compose the CRL can be kept to a small enough number. Thus, the lens does not become too long or the aspect ratio too large such that the lens is difficult to align in the x-ray beam (or too expensive to manufacture).

In the new art, lenses are designed to operate just below the K- or L-edge photon energy of the material from which the lenses is fabricated. The photon-energy region below the K- or L-shell absorption edge is more transparent to x-rays with energies just above the absorption edges, thus making the material a bandpass structure for the x-rays below the edge. Designing the lenses to operate at photon energies below the edge results in CRLs that are more transparent to the x-rays and have higher gains than those designed elsewhere. Such designs also help in utilizing higher Z-materials for the lenses, resulting in the benefits of a lower number of individual lenses for the CRL, and minimizing the overall length of the CRL and its aspect ratio.

In summary, since the compound refractive lens can tolerate a small random displacement of the individual lens elements off the average axis, the individual lens elements can be manufactured in the new art as independent units rather than fabricated out of one substrate material. The individual units can then be supported by simple alignment means, permitting the lenses to be thinner than those of the prior art. This reduces the total x-ray absorption for the compound refractive lens, which in turn permits the utilization of more individual lens elements and, hence, reduces the focal length of the compound refractive lens (since $f \propto 1/N$, see eqn. (3)).

The advantages of the present invention are:

A reduced criterion for unit lens axis alignment. This permits the use of easily fabricated alignment and support structures for the unit lenses.

Individual lens elements to be fabricated as separate units before final assembly in a compound refractive lens.

The fabrication of unit lenses which are thinner (than those manufactured using the single substrate compound lens with holes or spheres), thereby reducing absorption of the x-rays in the lens materials and increasing the frequency range of use.

The fabrication of both concave and convex lenses (convergent and divergent lenses).

The fabrication of more optimal lens surface shapes such as parabolic and Fresnel surfaces.

Manufacturing and fabrication techniques developed for lenses in optical (visible) region of the spectrum can be used.

Manufacturing of unit lenses can be performed by existing machine shop techniques, injection-molding techniques, compression-molding techniques and lithographic techniques.

The use of a greater variety of materials including plastics and higher Z-materials.

The fabrication of compound refractive lens systems that include, for example, achromatic x-ray lens systems, x-ray telescopes and x-ray microscopes.

The fabrication of lenses that can operate in the very hard x-ray region of the spectrum with lengths and aspect ratios that are not too large for lens alignment nor deleterious to the cost of fabrication.

DRAWING FIGURES

In the drawings, closely related figures have the same number but different alphabetic suffixes.

FIG. 1A shows a top view of a prior art single unit lens made of a hole in a substrate.

FIG. 1B shows a top view of a prior art cascaded x-ray refractive lens composed of multiple holes disposed in a single substrate for easy fabrication.

FIG. 2 shows a prior art concept for a linear series of refractive lenses to make a compound lens.

Figure 16:
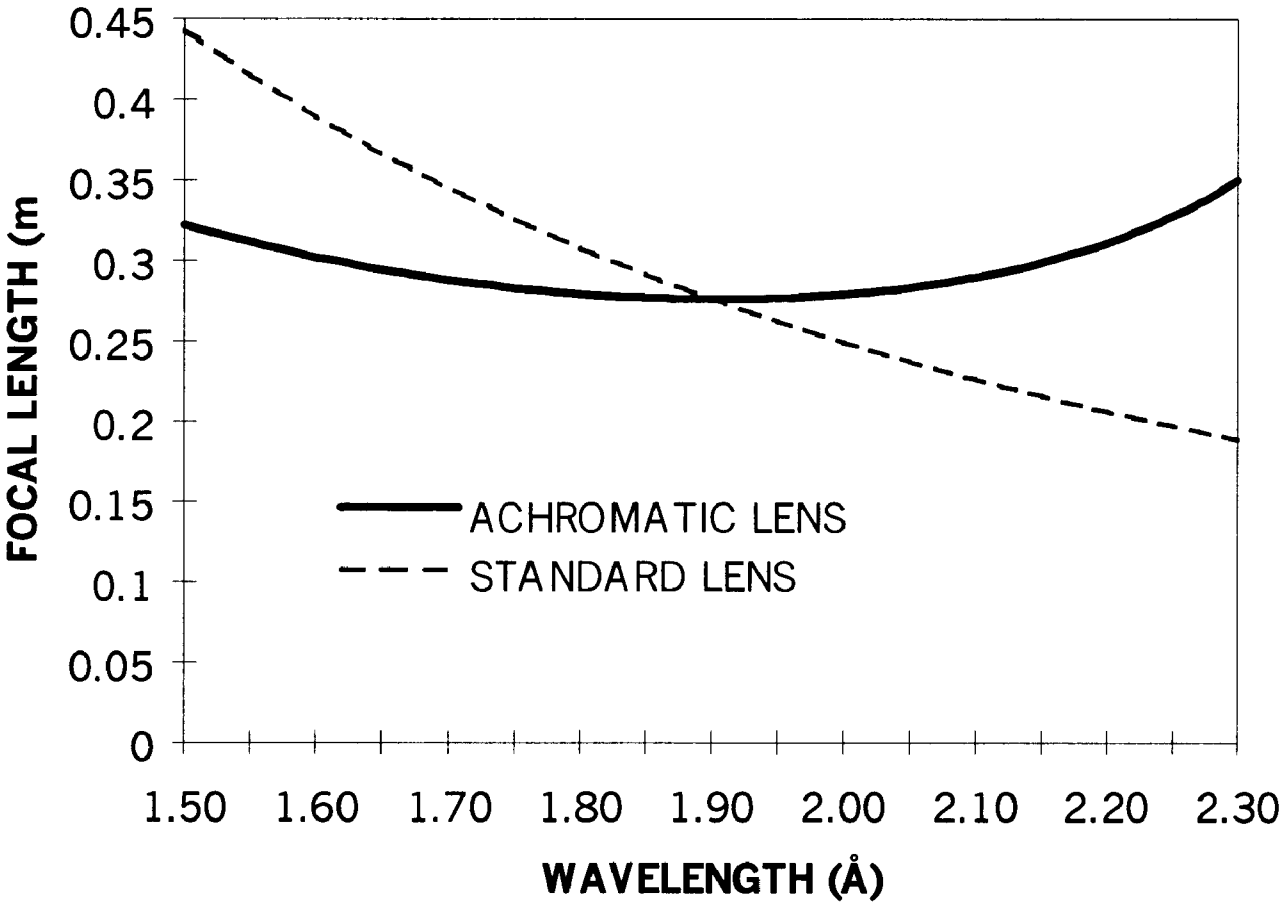

FIG. 16 compares the achromatic x-ray lens focal length (as a function of x-ray wavelength) with that of a single standard refractive x-ray lens pair.

Figures 17A, 17B:
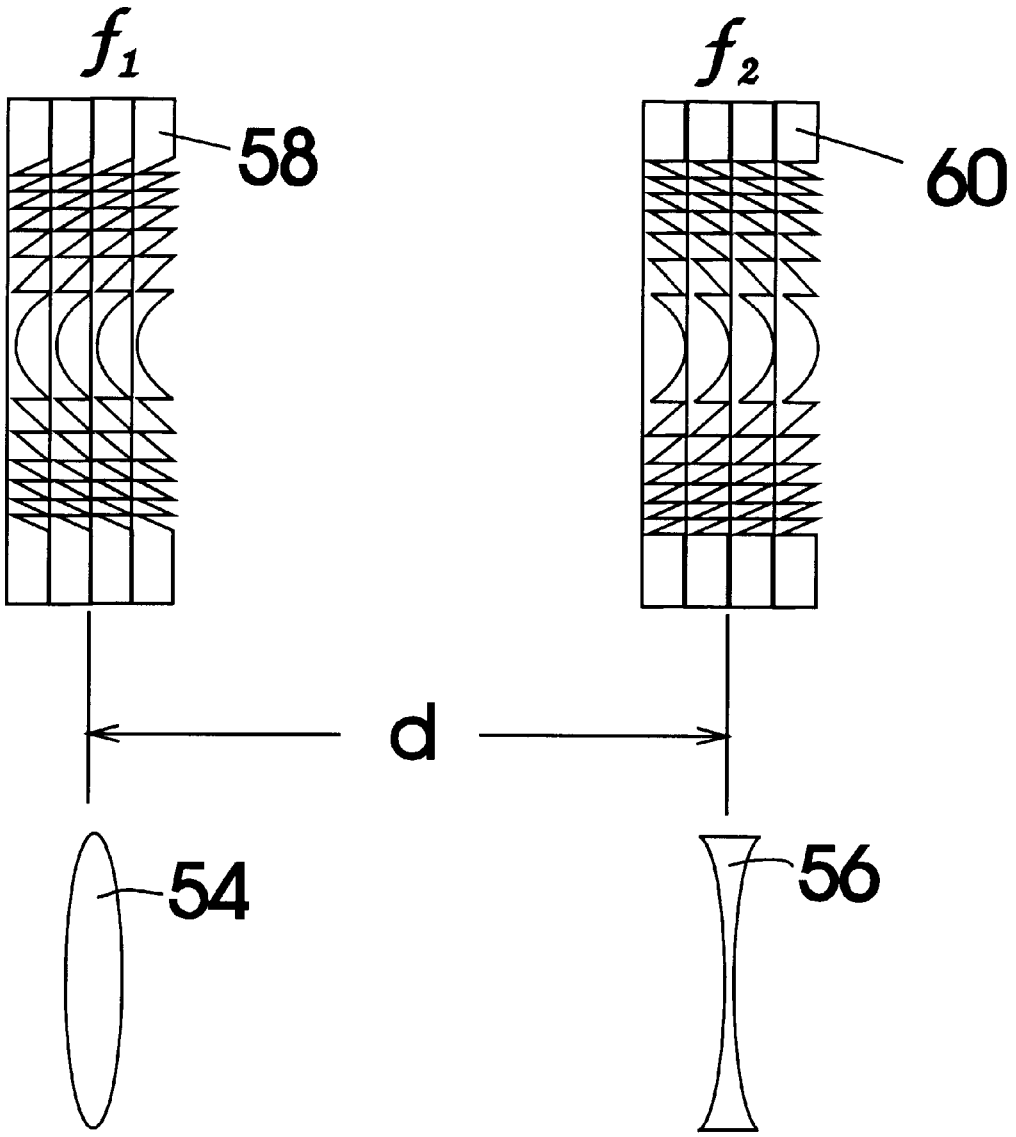

FIG. 17A shows compound refractive lenses (one plano-concave and the plano-convex) separated by an appropriate distance to make an X-ray Galilean telescope.

FIG. 17B shows the visible optical equivalent of FIG. 17A.

Figure 18:
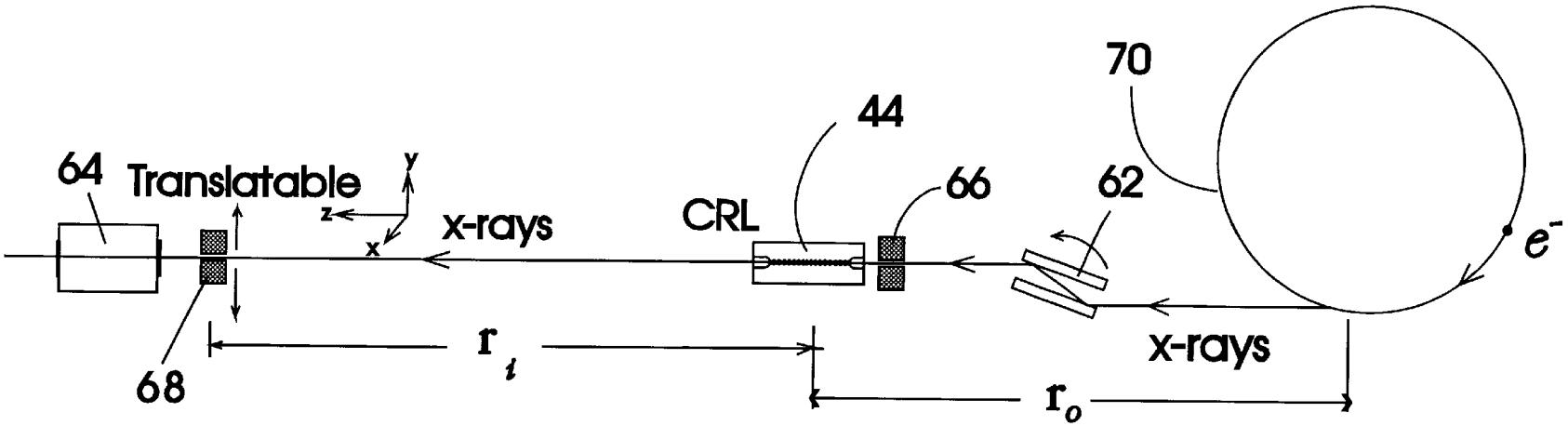

FIG. 18 shows the experimental apparatus for measuring the focal spot size and focal length of the CRLs.

Figure 19:
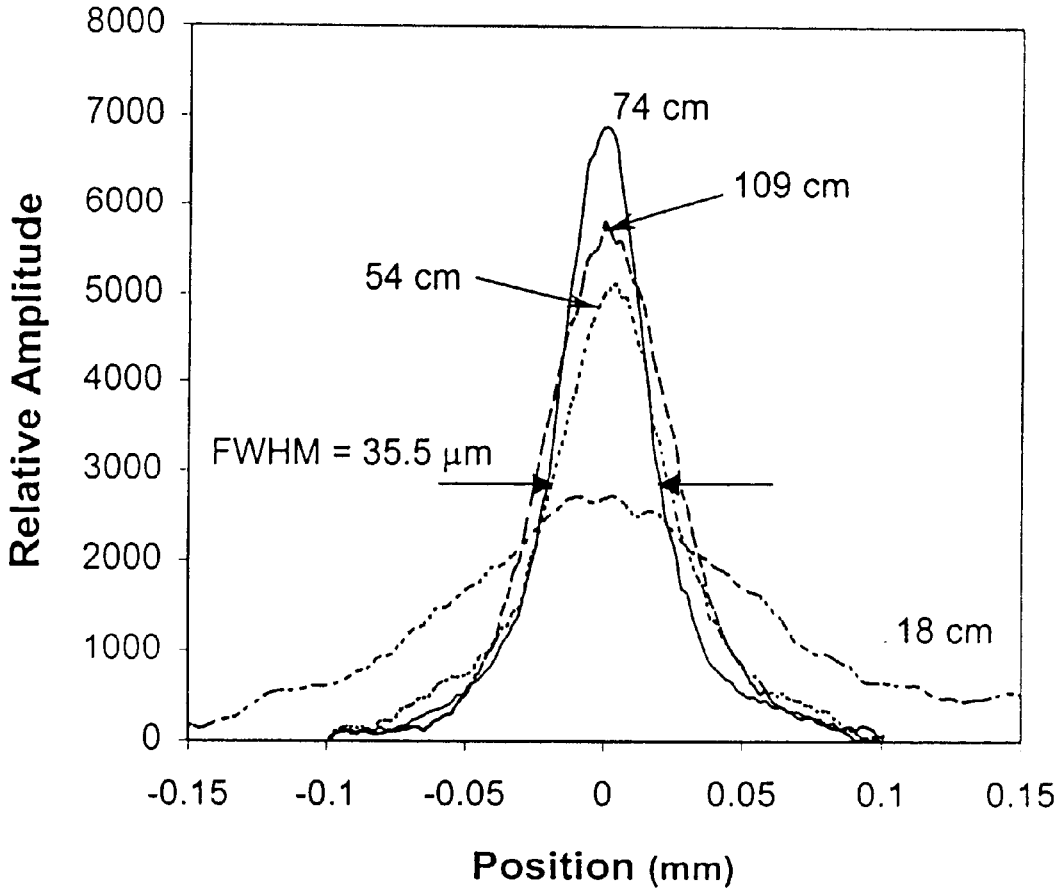

FIG. 19 shows the vertical cross section of the x-rays as a function of the transverse distance for three distances from the CRL.

Figure 20:
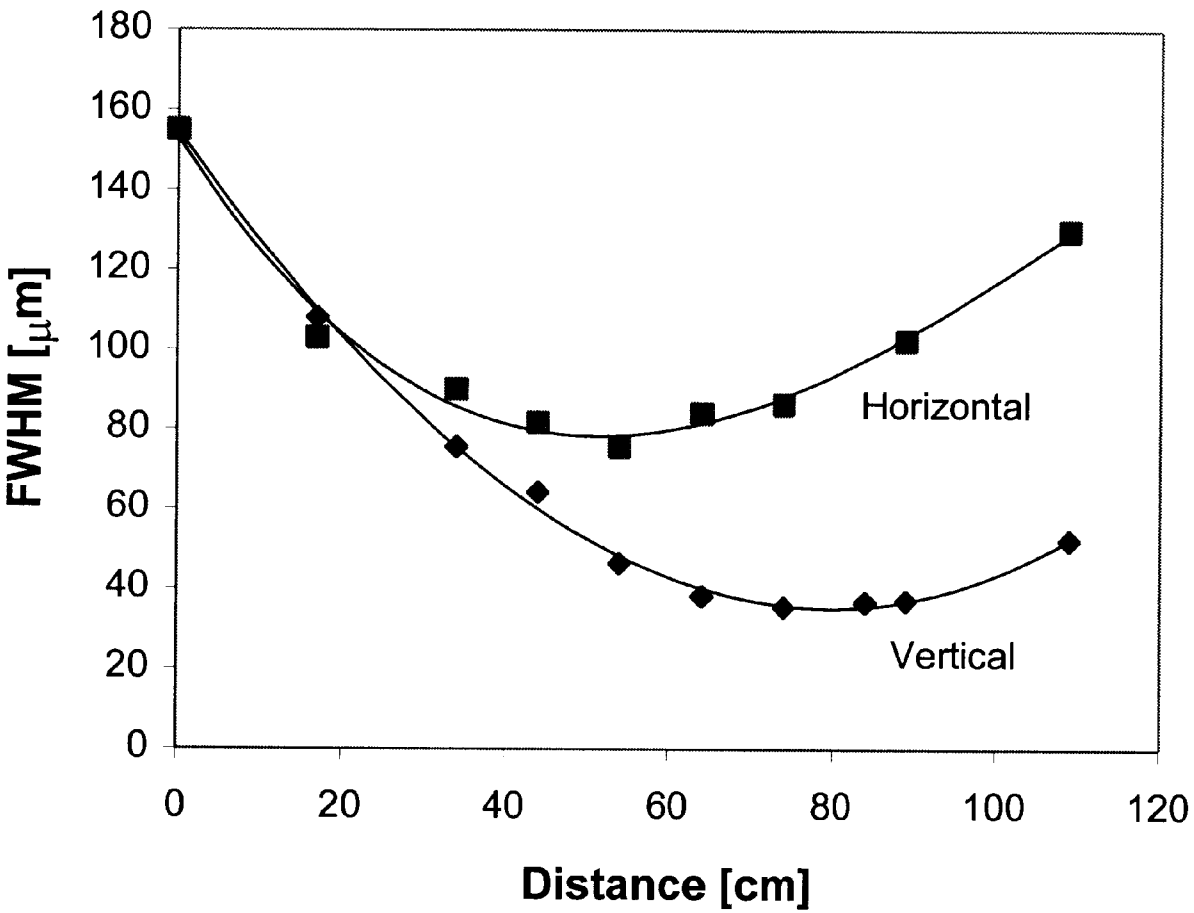

FIG. 20 shows a plot of the x-ray beam cross section for the horizontal and vertical planes as a function of distance from the CRL.

REFERENCE NUMBERS IN DRAWINGS

| Reference Numbers In Drawings | |
|---|---|
| 2 hollow cylinder | 4 plano-concave lens |
| 6 bi-concave cylindrical lens | 8 mean optical axis |
| 10 unit lens | 12 bi-concave parabolic lens |
| 14 cylindrical hole | 16 support ring |
| 18 support cylinder | 20 support disks |
| 22 plug | 24 thin film |
| 26 hole in support disk | 28 stainless steel ball |
| 30 spherical lens | 32 parabolic lens |
| 34 Fresnel segments | 36 absorbing segment |
| 38 alignment hole | 40 alignment rod |
| 42 Fresnel lens | 44 compound refractive lens (CRL) |
| 50 support plate | 52 fastening element |
| 54 plano-convex optical lens | 56 plano-concave optical lens |
| 58 plano-concave CRL | 60 plano-convex CRL |
| 62 double crystal monochromator | 64 ionization chamber |
| 66 entrance slits | 68 translatable detector slits |
| 70 synchrotron x-ray source | 72 cylindrical lens |

SUMMARY

In accordance with the present invention a compound refractive lens for the collection, focusing and collimation of x-rays, consisting of N individual unit lenses numbered i=1 through N with each unit lenses substantially aligned along an axis, such that the i-th lens has a displacement $t_i$ orthogonal to said axis, with said axis located such that $$\sum_{i=1}^{N} t_i = 0,$$

and wherein each of said unit lenses comprises a lens material having a refractive index decrement $\delta<1$ at a wavelength $\lambda<100$ Angstroms.

DETAILED DESCRIPTION OF THE PREFERRED EMBODIMENT

1. Misalignment of Lenses

Figure 3A:
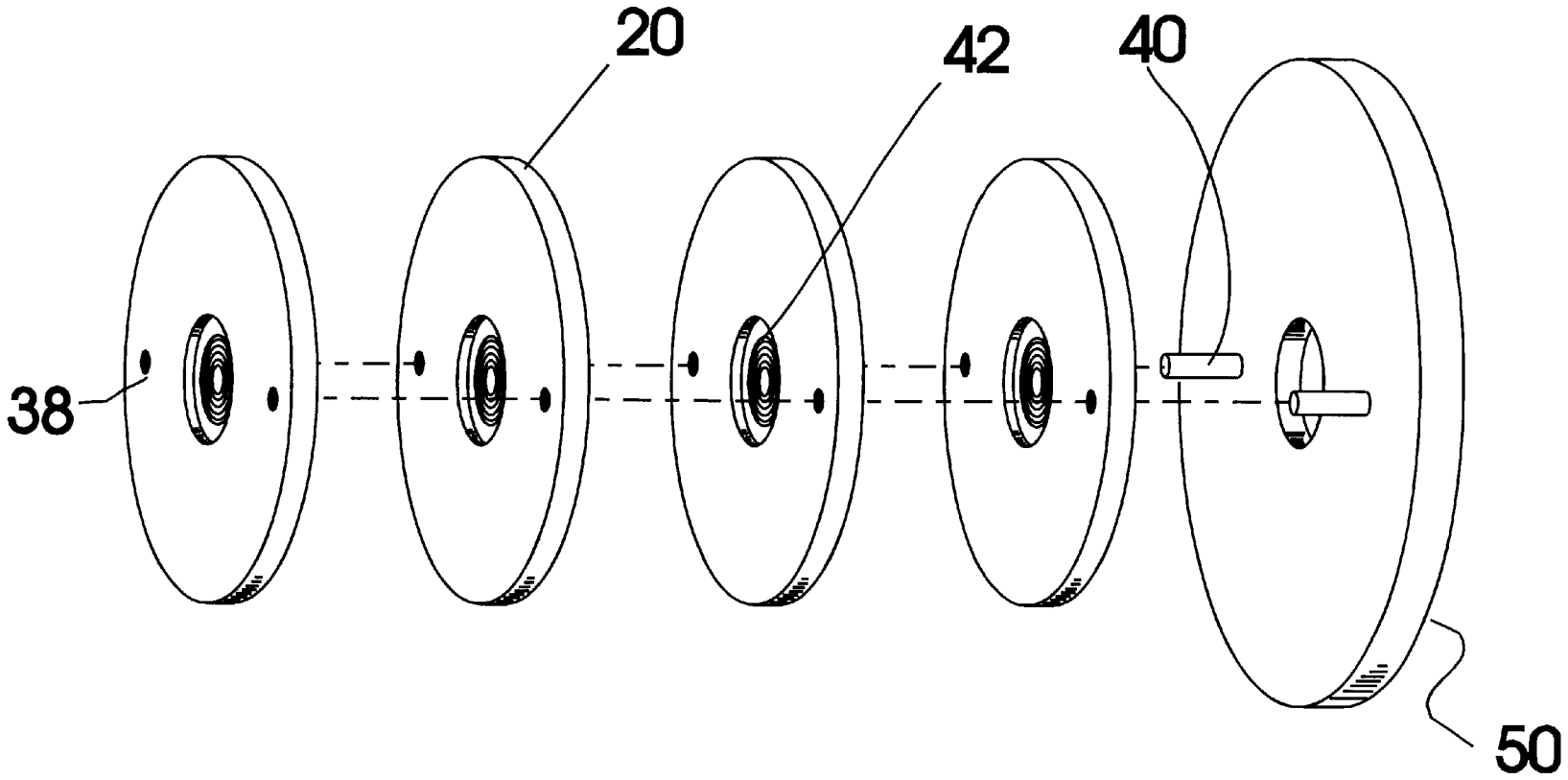
FIG. 3A shows a linear series of thin Fresnel lenses supported and aligned concentrically.
Figure 3B:
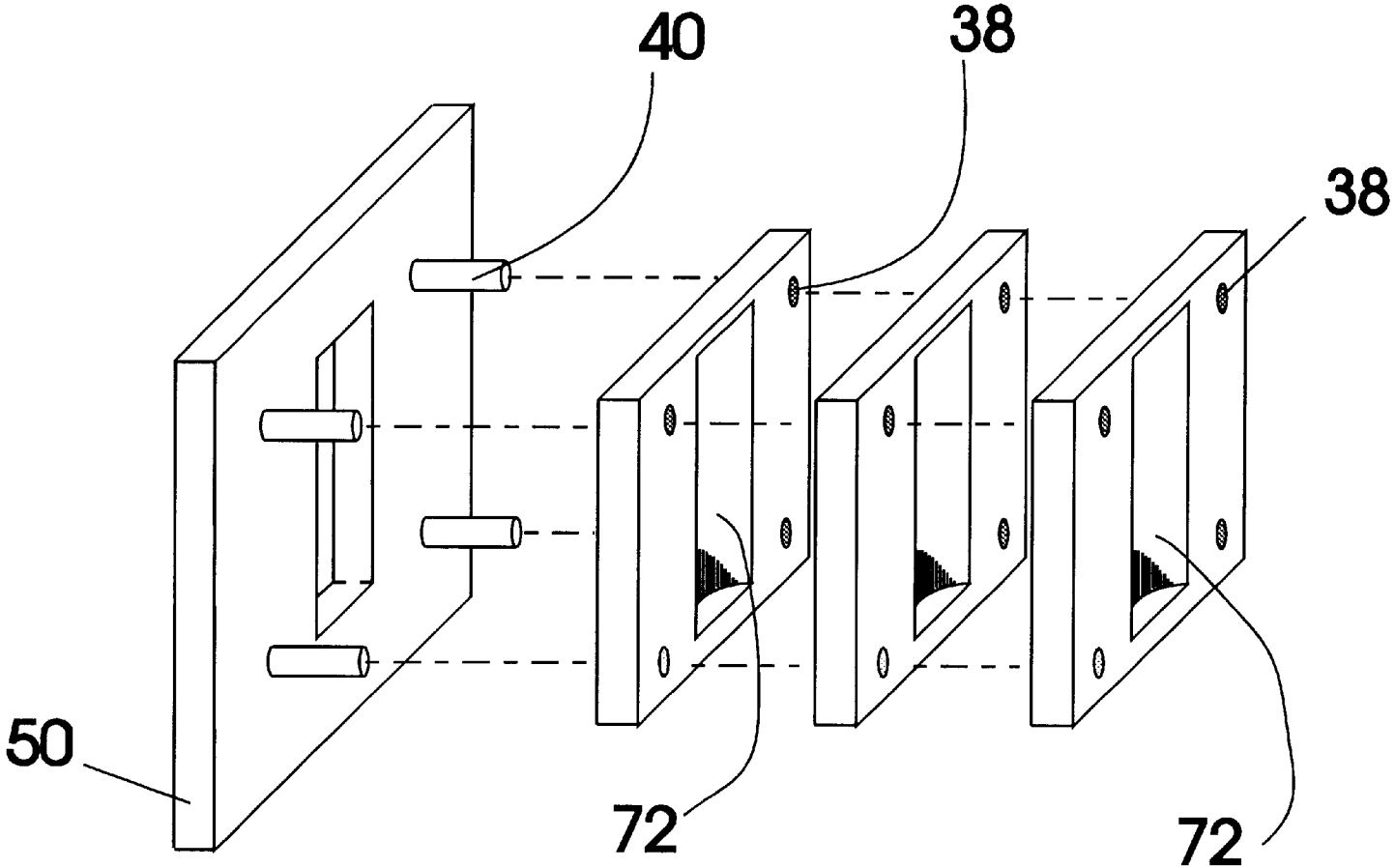
FIG. 3B shows a linear series of thin cylindrical lenses supported and aligned linearly.

Typical embodiments of the present invention are shown in FIG. 3A and FIG. 3B. FIG. 3A illustrates that the individual Fresnel lenses 42 are manufactured as separate parts with support disks 20 and aligned using alignment rods 40 and alignment holes 38 and supported by a support plate 50.

FIG. 3B shows an embodiment capable of one-dimensional focusing. The unit lens is a cylindrical lens 72. Alignment rods 40 with holes 38, support disks 20, and support plate 50 serve the same function as in the embodiment of FIG. 3A.

Figure 4A:
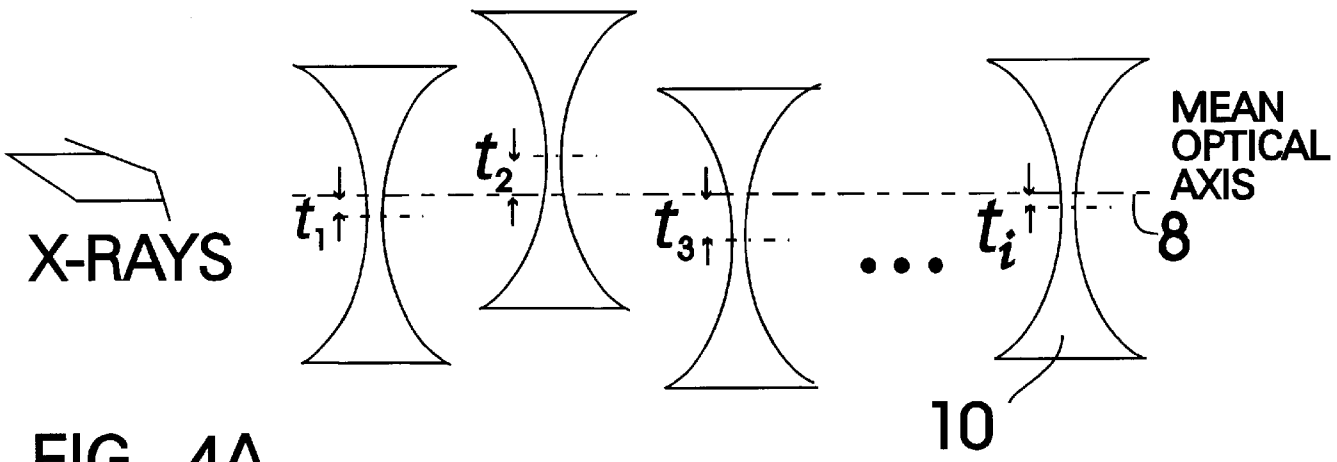
FIG. 4A shows a series of refractive lenses that are randomly separated from the average optical axis of the lens system.

These common machining techniques of alignment rods 40 and alignment holes 38 in FIGS. 3A and 3B can be utilized because there can be a displacement (or error) off the mean optical axis 8 as illustrated in FIGS. 4A. In the present invention the individual displacements are viewed as unavoidable errors that are intrinsic with any repetitious mechanical system. In FIGS. 3A and 3B the displacement of the unit lenses is minimized by the alignment rods 40. Other alignment means, such as a placing the unit lenses with their contiguous support disks 20 into a tightly fitting tube, can also be used. Such an arrangement allows the individual lenses to be manufactured individually and, thus, allowing more complex lens surfaces, such as Fresnel surfaces, to be fabricated.

The individual lens units of FIGS. 3A and 3B can be plano-concave, bi-concave, plano-convex or bi-convex (the only difference is that these lenses will operate in an opposite fashion to those of optical (visible) lenses in that the concave lenses will focus and the convex lenses will diverge the x-rays). The surface shape of the lenses can be cylindrical, spherical, parabolic, or Fresnel.

To understand the effects of random displacements of the lenses on the performance of the CRL, we perform the following analysis. As shown in FIG. 4A where each unit lens 10 is seen to be displaced slightly off axis by a distance $t_n$, where n=1, 2, . . . , N. To the first order, it will be shown that if $$\sum_{i=1}^{N} t_i = 0$$

the focal point will occur along the line for which the mean displacement of the lenses is zero, and the performance of the lens is only slightly altered.

Figure 4B:
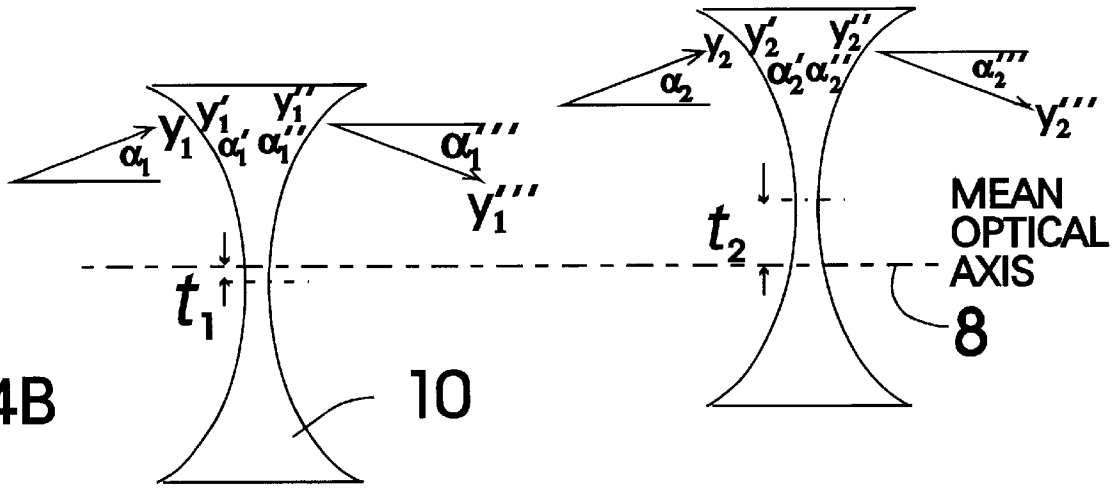
FIG. 4B shows a detailed view of the first two lenses of the lenses of FIG. 4A.

Each of the N lenses of radius of curvature R can have an offset $t_i$ transverse from a reference axis with i=1 . . . N. The reference axis is a line that passes through all N lenses and, in the case of perfect lens alignment, can be the line along which all the lenses' centers reside. Consider the case of two thin lenses (FIG. 4B). For a thin lens, the radial displacement, $y_i$, of the optical ray is assumed to be small in the lens. This assumption is equivalent to saying that the lens thickness is much smaller than its focal length, an easily satisfied condition for x-ray refractive lens elements. We also assume in this analysis that the individual displacements of the lenses, $t_i$, is smaller than the diameter of the radius of the aperture of the lens. We also assume that $\delta=(n-1)$ is much less than one or a $\delta<<1$.

Referring to FIG. 4B, we calculated the following equations for the radial positions $y_1$ and $Y_2$ and angular positions $\alpha_1$ and $\alpha_2$ through the two lenses.

$$\alpha_1' = (1+\delta)\alpha_1 - \frac{\delta}{R}y_1 + \frac{\delta}{R}t_1 \tag{7}$$

The thin lens approximation permits:

$$y_2=y_1 \tag{8}$$

$$\alpha_1'=\alpha_1'' \tag{9}$$

$$\alpha_1''' = (1-\delta)\alpha_1'' - \frac{\delta}{R}y_1 + \frac{\delta}{R}t_1 \tag{10}$$

Noting that $\alpha_1'''=\alpha_2$, then:

$$\alpha_2 = \alpha_1''' = \alpha_1 - \frac{2\delta}{R} y_1 + \frac{2\delta}{R} t_1 \tag{11}$$

For the case of N lenses and, again, using the thin lens approximation, we have:

$$y_{out}=y_{in} \tag{12}$$

$$\alpha_{out} = \alpha_{in} - \frac{2N\delta}{R} y_{in} + \frac{2\delta}{R} \sum_i t_i \tag{13}$$

Thus provided that $$Ny_{in} \gg \sum_i t_i,$$

misalignment of the lenses does not affect the focal behavior of the compound refractive lens. Furthermore, if one chooses the optical axis along the line that provides no mean displacement $$\left(\sum_{i=1}^{N} t_i = 0\right),$$

there is no first order displacement effect for all y. This line is termed the mean optical axis 8 of FIG. 4A.

We can also see the effect of misalignment by arranging these equations using a matrix. The system matrix relating the output paraxial ray parameters (transverse position $y_{out}$, slope $\alpha_{out}$, ratio of index of refraction decrement $\delta$ over lens' radius R) to the input ray parameters (transverse position $y_{in}$, slope $\alpha_{in}$, ratio of index of refraction decrement $\delta$ over lens' radius R) is:

$$\begin{bmatrix} y_{out} \\ \alpha_{out} \\ \frac{\delta}{R} \end{bmatrix} = \begin{bmatrix} 1 & 2RN & 2R\sum_{i=1}^{N} t_i \\ \frac{-2\delta N}{R} & 1 & 2\sum_{i=1}^{N} t_i \\ 0 & 0 & 1 \end{bmatrix} \begin{bmatrix} y_{in} \\ \alpha_{in} \\ \frac{\delta}{R} \end{bmatrix} \tag{14}$$

For lenses aligned along a reference axis with $t_i=0$ for i=1 . . . N or for these same lenses misaligned by offsetting the lenses transversely from a reference axis such that $$\sum_{i=1}^{N} t_i = 0$$

we have a simpler matrix relating the output to input ray parameters:

$$\begin{bmatrix} y_{out} \\ \alpha_{out} \end{bmatrix} = \begin{bmatrix} 1 & 2RN \\ \frac{-2\delta N}{R} & 1 \end{bmatrix} \begin{bmatrix} y_{in} \\ \alpha_{in} \end{bmatrix} \tag{15}$$

This is the same matrix that would result for the simple case of lenses that are completely aligned. Thus, for a set of lenses misaligned transversely about some reference axis, we can find some parallel axis that contains the focal point of the x-rays passing through the misaligned row of lenses. For perfectly aligned lenses with their centers lying along a straight line the focal point is found on this same line. With lenses transversely unaligned, the line with the focal point is the line that has the summed offset (sum of plus and minus transverse distances of the N lenses) equal to zero. Thus, the focal point will occur along the line for which the mean displacement of the lenses is zero, i.e.

$$\sum_{i=1}^{N} t_i = 0. \tag{16}$$

In this case the equations for $y_{out}$ and $\alpha_{out}$ are identical to the equations for perfectly aligned holes, and so there is not any alteration of the image.

Next it will be shown that current standard machining practices can be used to achieve adequate alignment and support of multiple lenses to achieve a reasonable focal length and that the prior art of Tomie has erroneously assumed too high a desired accuracy for the alignment of the unit lenses relative to one another.

2. Lens Misalignment

To check if there is a decrease in the compound refractive lens aperture or transmission due to unit lens misalignment, we performed two analyses: (1) parabolic lenses with loss and (2) spherical lenses with no loss.

2.1. Parabolic Lenses with Loss

Figure 5A:
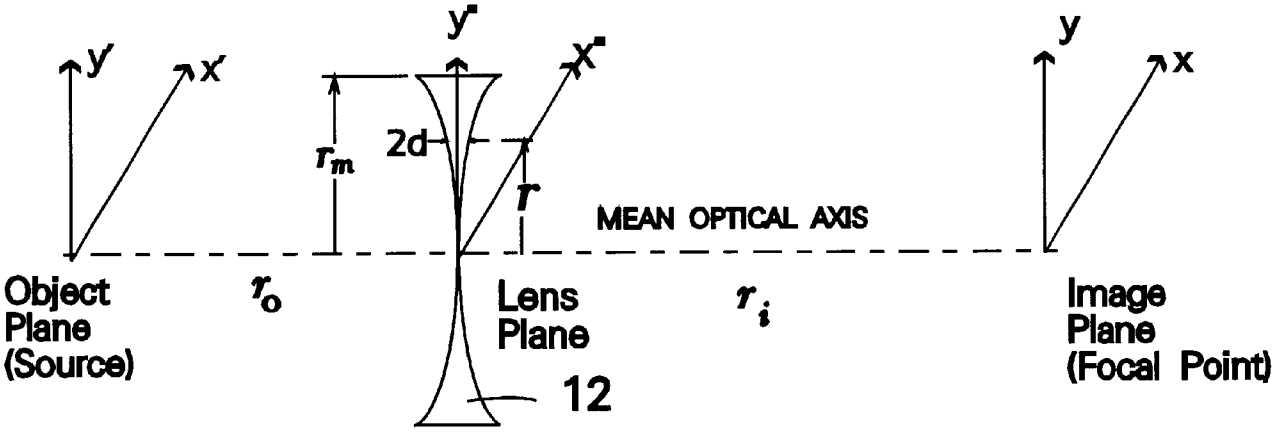
FIG. 5A shows a cross section of a parabolic ultra-thin lens.

A more precise way of looking at the effects of misalignment of the lens is to determine the phase of the x-rays at the image point to see what kind of phase distortion occurs due to this misalignment. Using FIG. 5A, for a single bi-concave parabolic lens 12 aligned along an axis over the region included within the aperture radius, $R_o$, the electric field phase is:

$$\phi_1 = a\left(-jk\delta - \frac{\mu}{2}\right)r^2 \tag{17}$$

where:

$$a = \frac{1}{2fN\delta} = \frac{1}{R_p},$$

k is the wavenumber, r is the radius shown in FIG. 5A, $R_p$ is the radius of curvature at the vertex of the parabolic lens (or 2 $R_p$ is the Latus Rectum of the parabola), complex number $j=\sqrt{-1}$, $\mu$ is the linear absorption coefficient of the material and the thickness of the lens is given by $2d=r^2/R_p$.

For a unit lens that has been shifted off axis by a distance t, the phase shift of the x-rays is given by:

$$\phi_1 = a(r+t)^2\left(-jk\delta - \frac{\mu}{2}\right) \tag{18}$$

Thus for a multiple-element lens, one sums the phase shifts from all the of the unit lenses to obtain the total phase swift $\phi$:

$$\begin{aligned} \phi &= -\frac{jk\delta + \mu/2}{2f\delta N} \sum_{i=1}^{N} (r+t_i)^2 \\ &= \frac{jk\delta + \mu/2}{f\delta N} \left\{ Nr^2 + 2r\sum_{i=1}^{N} t_i + \sum_{i=1}^{N} t_i^2 \right\} \end{aligned} \tag{19}$$

If one chooses the origin for r such that $$\sum_{i=1}^{N} t_i = 0,$$

one can see that the focal length remains the same and it will be along the axis for which $$\sum_{i=1}^{N} t_i = 0.$$

The equation for the phase for that case is:

$$\phi = -\frac{jk\delta + \mu/2}{2f\delta N}\left[Nr^2 + \sum_{i=1}^{N} t_i^2\right] \tag{20}$$

Note that $$\sigma_t^2 = \frac{1}{N}\sum_{i=1}^{N} t_i^2$$

where $\sigma_t^2$ is the variance for the $t_i$ distribution (or the $2^{nd}$ moment about the mean). Eqn (20) can then be written as:

$$\phi = -\frac{jk\delta + \mu/2}{2f\delta}[r^2 + \sigma_t^2] \tag{21}$$

This is the equation for the phase of the x-rays at the focal spot along the axis for which $$\sum_{i=1}^{N} t_i = 0.$$

The second term, $\sigma_t^2$, in the equation is independent of r, and therefore simply adds as a constant phase term to the overall phase. Thus, there is no phase distortion or degrading of the image. Hence, the focused image remains the same, but along the axis for which $$\sum_{i=1}^{N} t_i = 0.$$

Assuming no random distribution of t ($\sigma_t$=0), the value for the aperture radius, r, at which the incident field is attenuated by $e^{-1}$ can be determined from eqn. (21). Defining the absorption aperture radius to be $r=r_a$ and the real term of eqn. (21) to be equal to 1:

$$\frac{\mu}{4f\delta}r_a^2 = 1 \tag{22}$$

or:

$$r_a = \left(\frac{4f\delta}{\mu}\right)^{1/2} \tag{23}$$

For a bi-concave spherical lens $$f = \frac{R_p}{2N\delta},$$

then eqn. (23) becomes:

$$r_a = \left(\frac{2R_p}{\mu N}\right)^{1/2} \tag{24a}$$

for the case of a piano-concave lens $$f = \frac{R_p}{N\delta}$$

and:

$$r_a = \left(\frac{4R_p}{\mu N}\right)^{1/2} \tag{24b}$$

Eqn. (24a) is identical to that of eqn. (4) with $R_h$ replaced by $R_p$. For a cylindrical piano-concave lens, eqn. (24b) would apply with $R^p$ replaced by $R_h$.

If there is now a random distribution of t, we can define a new loss aperture radius, $r_{a'}$, for r and noting that the original loss aperture is given by the absorption aperture radius, $r_a$, (see eqns.(24a) and (24b)) and where the incident field is attenuated by $e^{-1}$. Setting the real part of eqn. (21) to 1 and solving the eqn for $r_{a'}$:

$$\frac{\mu(r_a')^2}{4f\delta} + \frac{\mu\sigma_t^2}{4f\delta} = 1 \tag{25}$$

we obtain:

$$r_a' = r_a\left[1 - \frac{\sigma_t^2}{r_a^2}\right]^{1/2} \tag{26}$$

For $r_a$=150 $\mu$m and $\sigma_t$=25 $\mu$m, then $r_a'$=0.986 $r_a$, corresponding to a 1.4% decrease in aperture and a corresponding 2.8% decrease in image intensity. If $\sigma_t$, becomes as large as 75 $\mu$m, or one-half $r_a$, then the absorption aperture decreases by 13.4% and the image intensity by a more considerable 22.1%. As a practical rule of thumb, the upper limit of $\sigma_t$ is $r_a$, or more generally $$\sigma_t < r_a. \tag{27}$$

There is also on-axis attenuation due to the random variation of the unit lenses off the mean axis. Setting r=0 in eqn. (21) one finds that:

$$\exp\left[\frac{-\mu\sigma_t^2}{2f\delta}\right] = \exp\left[\frac{-\sigma_t^2}{r_a^2}\right] \tag{28}$$

As previously, if $\sigma_t < r_a$, then the on-axis absorption is not appreciable except when $\sigma_t$ is close to $r_a$.

Eqns. (24a) and (24b) also works for a spherical lens with $R_p$ replaced by the radius of the sphere $R_s$ or, $$r_a = \left(\frac{2R_s}{\mu N}\right)^{1/2} \tag{29a}$$

For a plano-concave spherical lens, it is:

$$r_a = \left(\frac{R_s}{\mu N}\right)^{1/2} \tag{29b}$$

2.2. Effect of Spherical Aberration

Figure 5B:
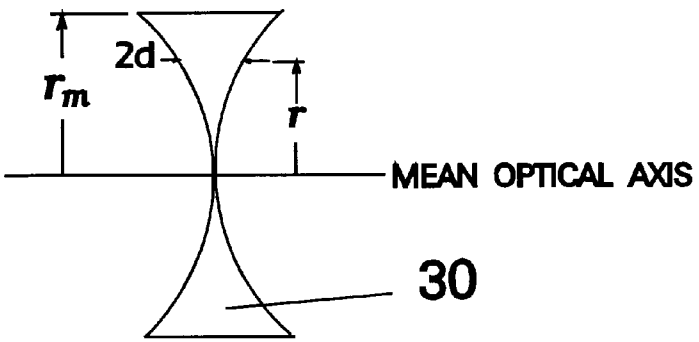
FIG. 5B shows a cross section of a spherical ultra-thin lens.

As Tomie teaches a sphere or a cylinder can approximate a parabolic surface for use as a lens. This can be seen from the following analysis. The equation of the thickness, 2d, of a bi-concave spherical lens 12 as shown in FIG. 5B may be expressed as:

$$2d = 2R_s - 2\sqrt{R_s^2 + r^2} \tag{30}$$

Expanding we find:

$$2d = \frac{r^2}{R_s} + \frac{r^2}{4R_s^3} + \cdots \tag{31}$$

where $R_s$ is the radius of the sphere. The first term of this expansion is the parabolic equation. Thus for small aperture radii (i.e. $r \ll R_s$), the first term of eqn. (31) represents a bi-concave parabolic lens. Parabolic lenses can ideally focus the x-rays. However if a bi-concave spherical lens is used, spherical aberration will results from all the terms beyond the first on the right-hand side of eqn. (31).

Considering the first two terms of eqn. (31), the corresponding phase shift $\phi$ of x-rays passing through the unit is given by:

$$\phi_1 = jk\delta\left(\frac{(r+t_1)^2}{R_s} + \frac{(r+t_1)^4}{4R_s^3}\right) \tag{32}$$

The first term on the right-hand side of eqn. (32) cancels the phase shift along different trajectories through the lens and so gives focusing. The second term is the spherical aberration. The phase shift through the entire lens is:

$$\phi = \frac{jk\delta}{R_s}\sum_{i=1}^{N}\left((r+t_i)^2 + \frac{(r+t_i)^4}{4R_s^2}\right) \tag{33}$$

or expanding:

$$\phi = \frac{jk}{8fR_s^2}r^4 + \frac{jk}{2f}\left(1 + \frac{3\sigma_t^2}{2R_s}\right)r^2 + \frac{jk}{2fR_s^2}\varepsilon^3 r + \frac{jk}{2fN}\left(N\sigma^2 + \sum_{i=1}^{N}\frac{t_i^4}{4R_s^2}\right) \tag{34}$$

where we have set:

$$\sum_{i=1}^{N} t_i = 0,\ \sigma_t^2 = \frac{1}{N}\sum_{i=1}^{N} t_i^2$$

is the variance and $$\varepsilon^3 = \frac{1}{N}\sum_{i=1}^{N} t_i^3$$

is the $3^{rd}$ moment about the mean and $$f = \frac{R_s}{2N\delta}.$$

Eqn. (34) can be used to illustrate how the use of spherical shapes limits the aperture size, changes the focal length and displaces the image point. The $r^4$ term (first term in eqn. (34)) corresponds to the spherical aberration, which is the same as for the perfectly aligned system. The parabolic aperture $r_p$ is determined by the value for $r=r_p$ where the phase shift due to the $r^4$ term is $\pi$:

$$\frac{k}{8fR_s^2}r_p^4 = \pi \tag{35}$$

Solving for $r_p$ we find $$r_p = \left(\frac{2R_s^3\lambda}{\delta N}\right)^{1/4} \tag{36a}$$

Which is identical to the Snigeriv formula for a cylindrical CRL, with $R_h=R_s$.

The use of spherical lenses results in a limited aperture. X-ray photons arriving outside this aperture will not focus at the same point as those inside. The parabolic aperture radius, $r_p$, must be modified for the cases of bi-concave spherical lenses and plano-concave spherical lenses. Thus for a bi-concave spherical lens of radius, $R_s$, the parabolic aperture radius is given by:

$$r_p = (4R_s^2\lambda i)^{1/4} = \left(\frac{2R_s^3\lambda}{\delta N}\right)^{1/4} \tag{36b}$$

For a spherical plano-concave lens:

$$r_p = (4R_s^2\lambda i)^{1/4} = \left(\frac{4R_s^3\lambda}{\delta N}\right)^{1/4} \tag{36c}$$

where the second equation in both eqn. (36b) and (36c) is approximately true if $r_o \gg f$.

The coefficient of the $r^2$ term ($2^{nd}$ term of eqn. (34)) corresponds to the new focal length f':

$$f' = \frac{f}{1 + \frac{3\sigma_t^2}{2R_s^2}} \tag{37}$$

For the case of large standard deviation in t where $\sigma_t \approx R_s/2$, then f'=0.73 f or a change in focal length of 22%. For large f, even this extreme in $\sigma_t$ may be tolerable. In conclusion we require that $\sigma_t < R_s/2$ to minimize the smearing of the focal length.

The r term ($3^{rd}$ term in eqn. (34)) corresponds to the transverse displacement of the image:

$$y = \frac{r_i \varepsilon^3}{2fR_s^2} \tag{38}$$

If the object distance $r_o$ is much greater than the focal length, f, then $f \approx r_i$ and one obtains:

$$y = \frac{\varepsilon^3}{4R_s^2} \tag{39}$$

This is a higher order term and can be neglected in most cases.

The last term in eqn. (34) is independent of r and does not affect the focusing.

Summing up, for spherical or hole lenses (where $R_h = R_s$) one can see that if $$\sigma_t < R_s/2, \tag{40}$$

then the displacement of the unit lenses around the common average axis does not appreciably influence the lens performance. Assuming that the minimum radius of curvature of the lens that one might want is 100 $\mu$m, the standard deviation in t, would need to be $\sigma_t \leqq 50$ $\mu$m, or less than or equal to 2 mills. Thus, using reasonable machine tolerances, the effect of lens misalignment is not significant in terms of reducing the focal length or intensity of the image. Most importantly, focusing can take place along an optical axis defined to be where the sum of the lens displacements is zero. The maximum displacement or misalignment of the individual unit lenses should be less than half the aperture of the unit lens.

From our analysis above, for spherical and parabolic unit lenses, size is limited either by the absorption aperture radius, $r_a$, or the mechanical aperture radius of the lens, $r_m$ (see FIGS. 5A–B), or whichever of the two radii is smallest or:

$$r_e = \mathrm{MIN}(r_a, r_m). \tag{41}$$

From eqn. (27), we also require that standard deviation of the random displacement of the unit lenses is less than the minimum effective radius, $r_e$, or $$\sigma_t < r_e. \tag{42}$$

Figure 10:
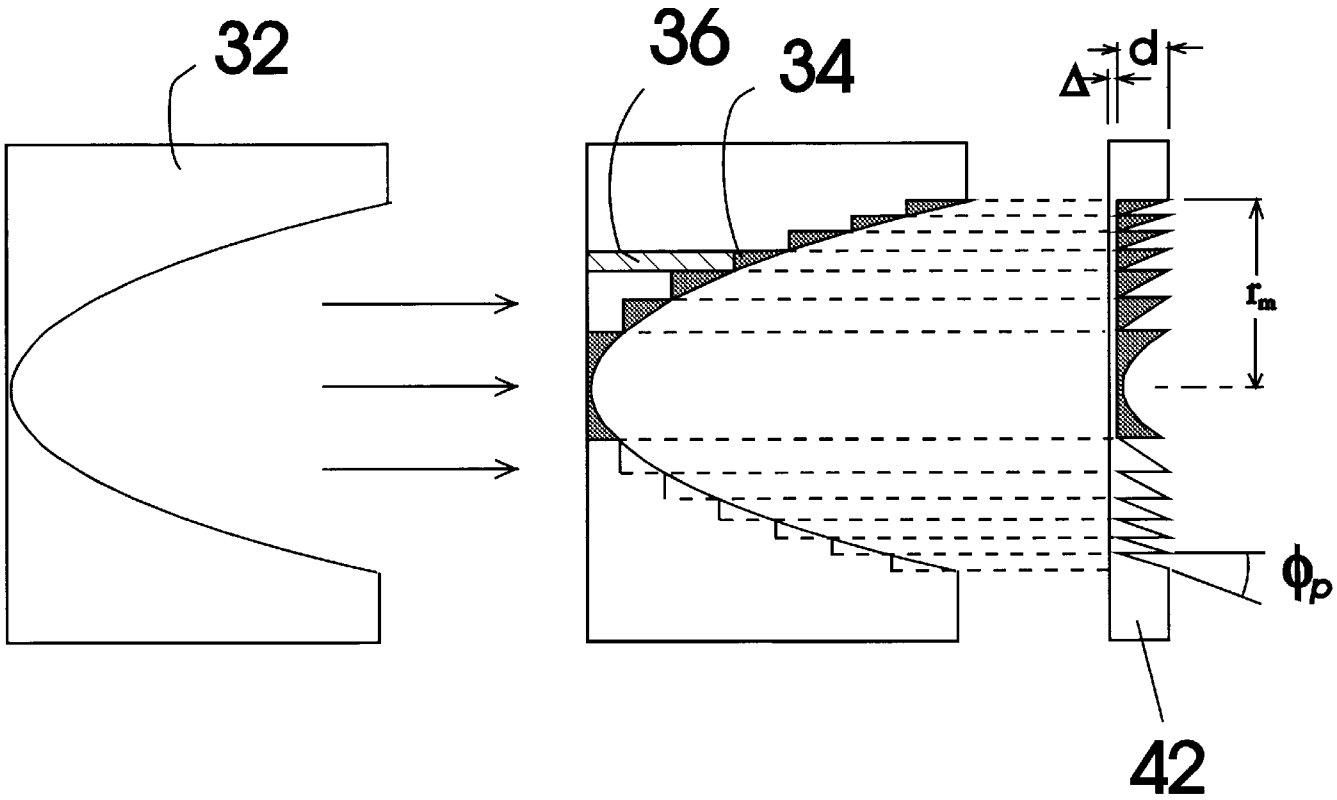
FIG. 10 shows how a Fresnel lens minimizes x-ray absorption and maximizes the lens aperture.
Figure 12B:
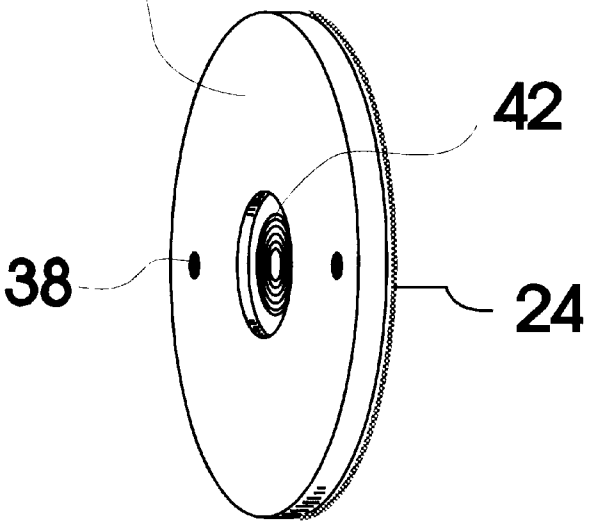
FIG. 12B shows an oblique view of the lens of FIG. 12A.
Figure 12A:
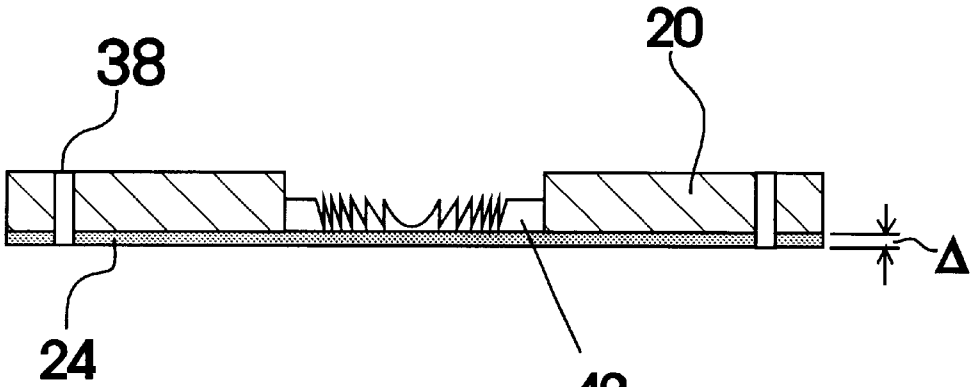
FIG. 12A shows side view of a unit lens formed by compression or injection molding of plastic on top of a thin plastic film.

If a refractive Fresnel lens is utilized, the lens is designed to minimize absorption, then the aperture radius of the lens is the mechanical aperture radius, $r_m$ (See FIGS. 10 and 12A for the Fresnel $r_m$). Thus for a Fresnel lens with little absorption, the requirement of $\sigma_t < r_m$, is all that is needed.

In conclusion, it has been shown that using reasonable machine tolerances the effect of lens misalignment is not significant in terms of reducing the quality or intensity of the image. Most importantly, focusing can take place along a mean optical axis (8 in FIG. 4B) defined to be where the sum of the lens displacements is zero. The root mean square of the displacements off the mean optical axis should be less than the effective aperture $r_e$, where $r_e$ is defined by eqn. (40).

3. Required Tolerance for the Lens Surface Features

Since lens' surfaces are not ideal and may contain imperfections, what is the effect on the image of thickness changes from the ideal parabolic surface? A change is the surface of the lens will result in a phase change for the x-rays traveling through the lens. Let $\Delta\tau$ be the thickness error in the lens surface. As can be seen from eqn. (33), the change in phase from such an error is given by:

$$\Delta\phi = k\delta\Delta\tau \tag{43}$$

A phase change of $\Delta\phi \geqq \pi/2$ will result in destructive interference; thus the allowable thickness error is given by:

$$\Delta\tau \leq \frac{\lambda}{4\delta} \tag{44}$$

If this same error exists in every lens at exactly the same position (not impossible, since these lenses may use reproduction techniques that yield almost identical lenses), then the phase error will add linearly. Then the maximum allowable error for each single lens is given by:

$$\Delta\tau_e \leq \frac{\lambda}{4\delta N} \tag{45}$$

As an example, consider an x-ray lens made of polyethylene. For 10 keV x-rays, $\delta = 2.28 \times 10^{-6}$ and N=100 (a hundred individual lenses), then $\Delta\tau_e \leqq 0.14$ $\mu$m or roughly a quarter wavelength ($\lambda/4$) of visible light. This is an achievable tolerance for ordinary optical (visible light) lenses. Thus, stated briefly, standard surface tolerances of optical lenses can be used for x-ray lenses. This is counter intuitive, given that we are utilizing lenses of optical quality to focus x-rays whose wavelengths are roughly a thousand times smaller.

If the surface errors are random, then an even larger tolerance can be allowed for the surface imperfections. This can be seen by assuming that error in $\Delta\tau$ is given by the probability function:

$$p(\tau) = \frac{1}{\sqrt{2\pi\sigma_s^2}} \exp\left(-\frac{(\Delta\tau)^2}{2\sigma_s^2}\right) \tag{46}$$

The surface errors (assumed to be random), $\Delta\tau$, are given by a probability distribution with a standard deviation of $\sigma_s$. Tolerance in surface imperfections is then defined by the condition that the standard deviation for the phase is $\Delta\phi \geqq \pi/2$. The variance for the phase distribution is then given by:

$$N(k\delta^2) \int_{-\infty}^{\infty} d(\Delta\tau) \frac{(\Delta\tau)^2}{\sqrt{2\pi\sigma_s^2}} \exp\left(-\frac{(\Delta\tau)^2}{2\sigma_s^2}\right) = \frac{2N(k\delta)^2\sigma_s^2}{\sqrt{2}} \tag{47}$$

To minimize phase distortion, the variance should be $\leqq (\pi/2)^2$. Using this condition and solving for $\sigma_s$ one obtains:

$$\sigma_s \leq \frac{\lambda}{4\delta\sqrt{N}} \tag{48}$$

Thus when the error position is random, the RMS value of $\Delta\tau$ goes as the square root of the number of foils. Comparing eqn. (48) to eqn. (45), one sees that when the error is random, the tolerance is increased by a factor of $\sqrt{N}$.

Given our example above of the polyethylene lens (N=100) at 10 keV, if the surface error is entirely random, then from eqn. (48) one can tolerate an error of $\Delta\tau_e \leqq 1.4$ $\mu$m, a factor of 10 higher than that required for the case where the error is identical for each lens. Thus, the tolerance of error in the lens surface is quite large and greater than that of even optical lenses. Thus, conventional machining and optical lens making techniques can be used for making individual lenses that can be mechanically stacked to form a compound refractive x-ray lens. Once again, this is counter intuitive given that we are utilizing lenses of optical or even infrared quality to focus x-rays whose wavelengths are anywhere from 1000 to 10,000 times smaller.

As one can see from comparing the required tolerances for unit lens alignment ($\sigma_t<r_e$) with the required tolerance for surface features (eqns. (45) and (48)) the requirement for alignment is less stringent. In the prior art of Tomie, he seems to have equated the requirement of alignment with that of surface tolerance (and even in that calculation, he appears to have miscalculated). He states, "For obtaining good focusing characteristics with a lens of this configuration, the machining has to be conducted at a high precision capable of keeping the geometric error within a small fraction of the value obtained by dividing the wavelength of the X-rays to be focused by δ of the lens material (=λ/δ)." In the case of machining one must assume that Tomie is stating both how accurate the surface of the holes (or lenses) must be and how accurate their position relative to one another must be. Thus he decides that to achieve such accuracy, one must utilizes holes in a common structure or material and not rely on individual separate unit lenses.

Tomie's teaching concerning this required accuracy of the geometric error is at best misleading and vague, assuming he means from the above quoted statement that his accuracy of the unit lenses relative to the optical axis for two lenses must be given by at $\sigma<\lambda/\delta$(or more accurately for N lenses $\sigma_t \leqq \lambda/4\sqrt{N\delta}$ as calculated by us (46) for $\sigma_s$). However, as we have shown this is the necessary accuracy of the surface features imperfection of the individual unit lenses for N lenses eqn. (46) and is not the needed accuracy of the unit lenses relative to their common average optical axis ($\sigma_t<r_e$). Tomie is incorrect to imply that the requirement of phase addition holds for the random displacement accuracy of the lenses off their common optical axis. Random displacement of the unit lenses does not add to geometric error. As we have proven, the root mean square of the variation of t need only be $\sigma_t<r_e$ where $r_e$ is the effective aperture radius of the unit lens [$r_e$=MIN($r_a$,$r_o$)]. If if the lens is spherical or made of round cylinders then we claim $\sigma_t<R_s/2$.

A stronger Claim that excludes the highly accurate alignment of the unit lenses as erroneously taught by Tomie ($\sigma_t<\lambda/4N\delta$) to require the alignment of the unit lenses to be such that the root mean square of the individual unit lens displacement, $\sigma_t$, off the average axis of the unit lenses must be such that:

$$r_e>\sigma_t>\lambda/4\pi\sqrt{N\delta} \tag{49}$$

This excludes the possible area of Tomie's teaching.

4. New Compound Refractive Lenses

Figures 6A, 6B, 6C:
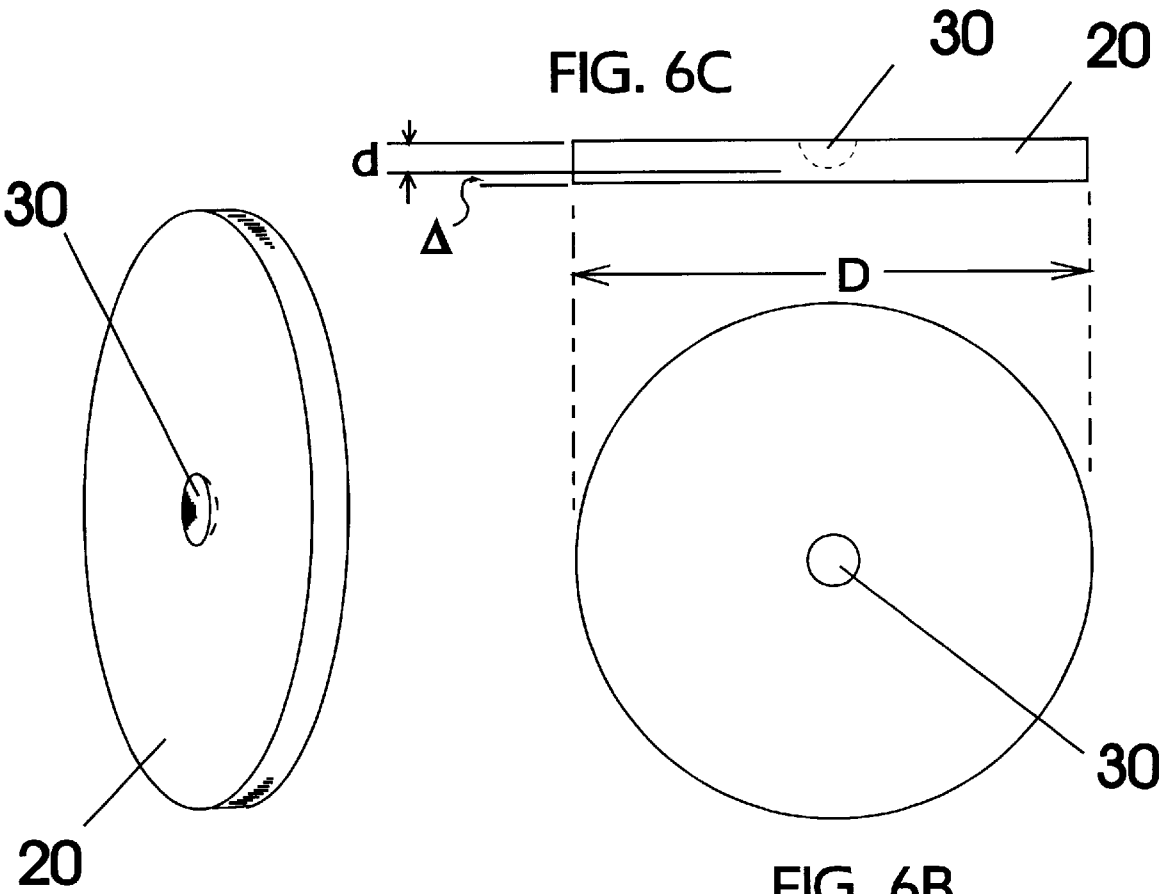
FIG. 6A shows an oblique view of a unit lens element for a compound refractive lens.
FIG. 6B shows a front view of the unit lens of FIG. 6A.
FIG. 6C shows a top view of the unit lens of FIG. 6A.

Since in most embodiments each individual lens element is small, a larger support structure (e.g. a ring structure) have been utilized to support and help align the individual lens elements. Three embodiments of the individual lens elements are shown in FIGS. 6–8. In the embodiment shown in FIGS. 6A to 6C, the individual lens element is fabricated on a disk 20 using conventional machining techniques. Unlike the prior art of FIG. 2, the thickness (d+Δ) of the disk 20 in FIG. 6A is thick enough for self support without mechanical and optical distortion. The thick disk 20 acts as the support and alignment element and as the lens material. The spherical lens 30 needs to be cut deep into the disk to minimize Δ.

FIG. 6A shows a oblique view of the unit lens, while FIG. 6B shows a side and front view of the unit lens. For a very inexpensive lens, a spherical shape can be easily obtained using a ball end mill. Machining the disk with ball end mill (using a milling machine) will result in a spherical lens 30 in the support disk 20. This spherical lens 30 gives an approximate plano-concave spherical lens. Identical lenses can be fabricated in this way.

To minimize the x-ray transmission loss, the minimum thickness of the lens, Δ, (see FIG.6B) must be fabricated to be as small as possible. Thus Δ is much smaller that d or Δ<<d. Current machining techniques limits Δ to approximately 25 μm. More complex lens' shapes can be machined for the spherical lens 30 using high precision lathes to obtain parabolic and Fresnel lens shapes. This embodiment would be good method to use for lenses made of metal substrates such as Be. Al was used in the present invention prototype.

Figure 7C:
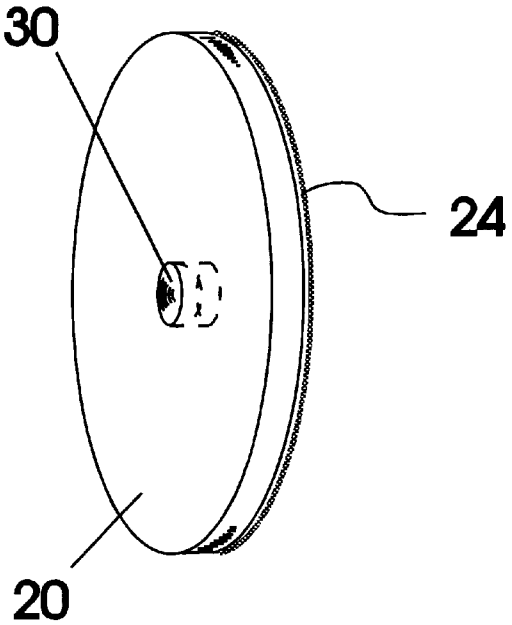
FIG. 7C shows an oblique view of the lens of FIG. 7B.
Figure 7A:
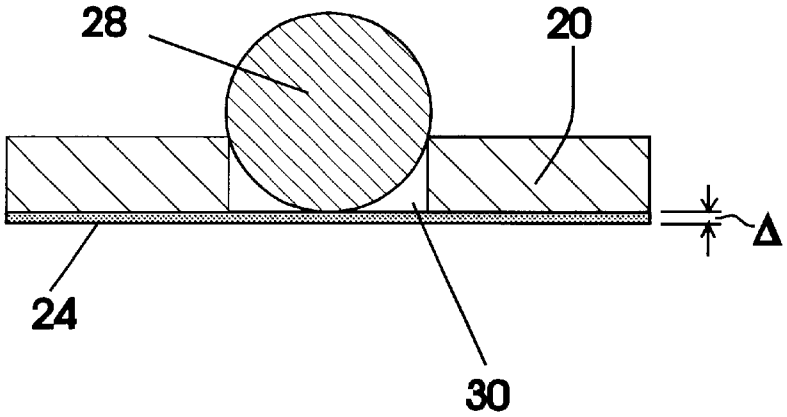
FIG. 7A shows a side view of an ultra-thin x-ray lens that utilizes a steel ball to form lens surface.
Figure 7B:
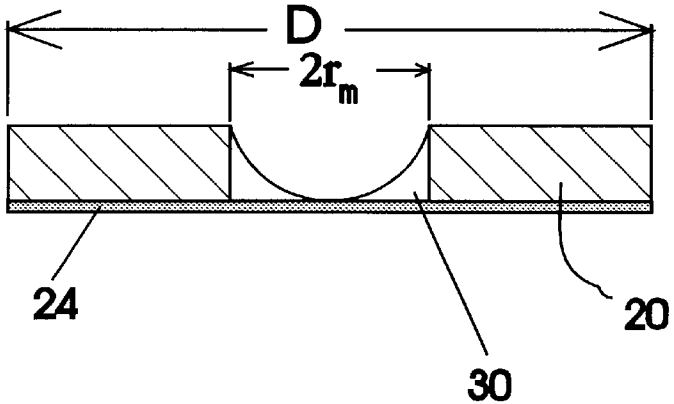
FIG. 7B shows a side of view of the lens of FIG. 7A with the steel ball removed.

A further reduction in the minimum lens thickness, Δ, were achieved using the method illustrated in FIGS. 7A to 7C. In that embodiment a spherical lens 30 is formed in epoxy by utilizing a stainless steel ball 28 as negative mold for the lens shape. A thin film 24, such as Mylar forms the thinnest element, Δ, of the spherical lens 30 which is plano-concave. Inexpensive thin films (e.g. Mylar and Kapton) are presently available in various sizes starting from 1.5 μm. These thin films are more durable than even metal films at thicknesses below 10 microns. A metal support disk 20 is fabricated such that the interior hole diameter is slightly smaller than the diameter of stainless steel ball 28. The simple supporting disk 20 can be machined by using a conventional lathe and drill. Liquid epoxy is inserted into the disk hole and the ball is then placed in the epoxy displacing some of the epoxy and forming the spherical lens shape, or dimple 30. After the epoxy has dried, the ball is removed. The formed lens is now at the center of the disk. Lathe machining permits accurate centering of the hole in which the lens is placed. FIG. 7B shows a side view of the completed lens. FIG. 7C shows a perspective view of the completed unit lens. Other embodiments described below also can be constructed using injection or compression molding to form the lens. X-ray refractive lenses have been fabricated using this technique.

Figure 8C:
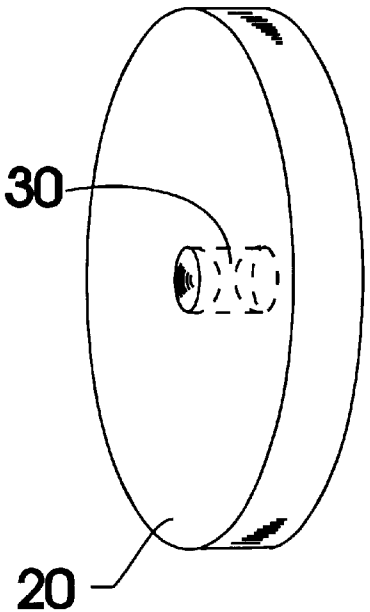
FIG. 8C shows an oblique view of the lens of FIG. 8B.
Figure 8A:
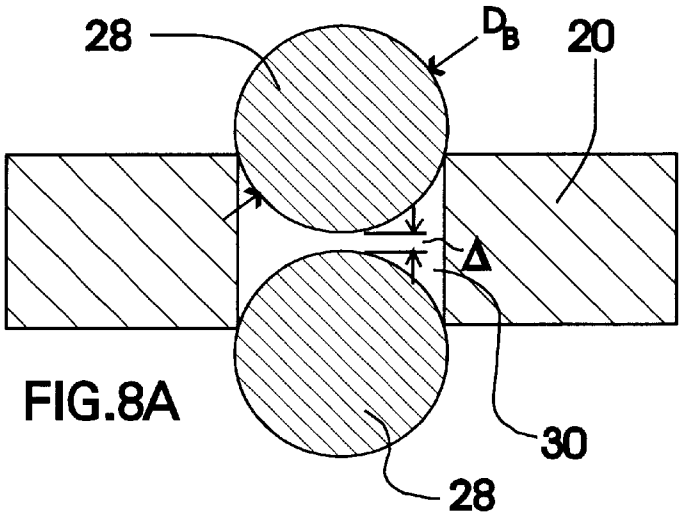
FIG. 8A shows a side view of an ultra-thin x-ray lens that utilizes two steel balls to form lens surfaces.
Figure 8B:
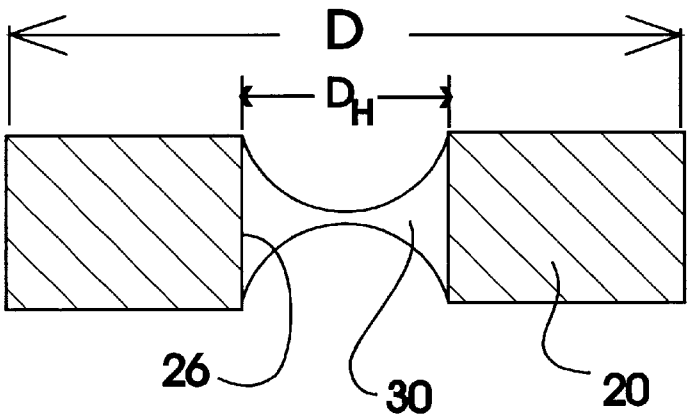
FIG. 8B shows a side of view of the lens of FIG. 8A with the steel balls removed.

A bi-concave lens was fabricated using two balls 28 as demonstrated in FIGS. 8A, 8B, and 8C. As before, stainless steel balls are used to determine the shape of the lens. Unlike the embodiment in FIG. 7, no support thin film need be used. The diameter, $D_H=2r_m$, of the hole 26 and diameter, $D_B$, of the balls 28 determines the lens' minimum thickness, Δ. $D_H$ is the mechanical aperture of the lens ($r_m$ is the mechanical aperture radius of the lens). Careful adjustment of $D_H$ permits minimum lens' thickness of less than 10 μm. As in the case of FIG. 7, liquid epoxy is inserted into the disk hole and the two balls are placed in the epoxy displacing some of the epoxy and forming the spherical lens' shape or dimple. After the epoxy has dried the ball is removed. FIG. 8B shows a side view of the completed lens. FIG. 8C shows a perspective view of the completed unit lens. Refractive lenses have been fabricated using this technique.

4b. Ultra-Thin Unit Lenses

Figure 9A:
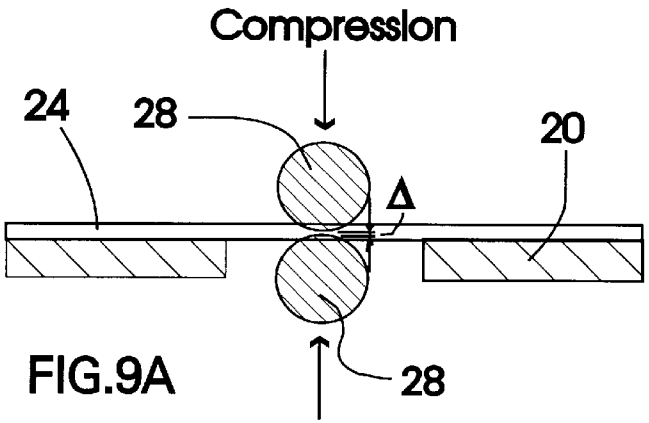
FIG. 9A shows an ultra-thin x-ray lens being made by two steel balls to form a bi-concave lens in a thin film by compression.
Figure 9B:
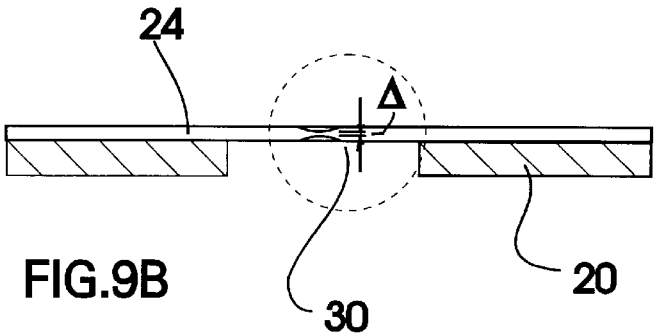
FIG. 9B shows a side view of the ultra-thin x-ray lens of FIG. 9A.
Figure 9C:
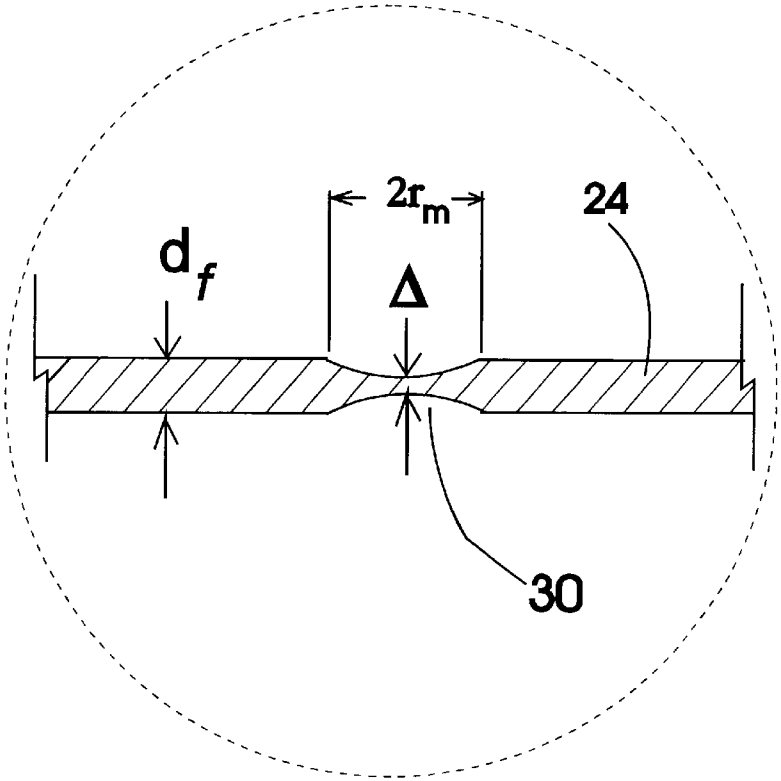
FIG. 9C shows a blown up view of the lens of FIG. 9B.

In a preferred embodiment developed by the inventors, thinner lenses have been made using thin films of material that are easily compressed between the two balls or two lens-shape dies (e.g. the shapes can be spherical, parabolic or Fresnel). In one version of this embodiment shown in FIG. 9, no epoxy is used. The imprint is pressed or stamped into the thin film. This can be done to produce plano-concave, bi-concave lenses, plano-convex, and bi-convex lenses (and their various Fresnel analogs). The case of a bi-concave unit lens with spherical surfaces is shown in FIG.

9. To manufacture this lens, a thin foil is placed on a support disk 20. This structure (thin 24 film and support disk 20) is then placed between two balls 28 such that the balls can compress the thin film 24 using moderate pressure. Not shown is the alignment jig for the two balls whose purpose is to maintain the balls 28 to be coaxial and perpendicular to the thin film 24 that is to be compressed. The jig provides for the impress of the unit lens such that they can be aligned with succeeding unit lenses to form a CRL. This embodiment has produced the thinner lenses than those of FIGS. 6A and 6B.

As an inexpensive proof of principal, stainless steel balls were used to impress the lens surface. Thin 25-$\mu$m Mylar film 24 was supported on a 0.4-mm brass plate and was suspended across a 3.17-mm hole in the plate using adhesive glue. The brass plate constituted the support and alignment element 20 of the unit lens. The two spheres 28 were brought on either side of the Mylar film and pressed as shown in FIG. 8. An alignment jig was utilized to align the spheres such that they would be directly opposite one another with the Mylar film in between. This alignment of the spheres was such that they produced spherical craters on either side of the thin Mylar film. When viewed by a microscope, the lenses were seen to be approximately 350 $\mu$m in diameter and of sufficiently good quality that they acted as optical (visible) lenses (when utilized with other optical lenses). Most importantly the minimum thickness of the lens $\Delta$ was approximately 5 $\mu$m. This significantly lowered the x-ray absorption in the lens when compared to the prior art hole lens that had a minimum thickness of 25 82 m—a factor of 5 improvement. Results of this lens are given later. Other materials have also been used for this embodiment such as aluminum and copper.

5. Use of Fresnel Compound Refractive Lenses 5.1. Thin Concave Fresnel Lenses Reduce Absorption In this embodiment, the compound refractive lens aperture sizes are increased by the use of Fresnel lenses. As we showed in FIG. 5A and eqn. (31), to achieve a parabolic shape a unit lens becomes thicker as r increases and, therefore, more absorbent for x-rays. Fresnel lenses are shown to minimize absorption and achieve larger clear apertures. An x-ray refractive Fresnel lens is constructed with stepped setbacks of many divided annular Fresnel segments 34, as is shown in FIG. 10. This figure shows how a parabolic lens 32 is conceptually converted to a refractive Fresnel lens. As shown, only the Fresnel segments 34 are useful for deflecting and focusing the x-rays. The absorbing segment 36 behind the Fresnel segment 34 is of no use and results in increased x-ray absorption. In the new art, each segment of the lens is approximately the same thickness. Each Fresnel segment 34 thickness is optimized to reduce x-ray absorption. This reduces the x-ray absorption in the outer radius of the lens but does not interfere with the lens' ability of refract the x rays. Indeed, the gain of the lenses increases with the number of Fresnel zones. The result is what appears to be a conventional optical Fresnel lens with negative curvature (plano-concave) capable of operation in the visible portion of the spectrum. As has been discussed previously, such a lens will act as positive lens focusing parallel-ray x-rays.

The design of the Fresnel lens for a compound x-ray refractive lens is different than for a conventional optical Fresnel lens. In the preferred embodiment the intention is to reduce the absorption and increase the aperture size. The x-ray lens does not function as a Fresnel zone plate in which diffraction dominates, but rather is based on refraction. To minimize the absorption and maximize the gain of the Fresnel lens array, it is important to optimized the position of the steps of the Fresnel lens.

5.2. Step Height

To maximize the gain of the Fresnel lens array, we have calculated the gain of the array as a function of step location and height. Since the absorption is increasing with step height, one might assume that the maximum height should be limited such that the maximum absorption was 1/e over that of the step trough (this is similar to the criteria that Sigernev used for determine the maximum absorption aperture of a cylindrical lens). However, selecting the maximum step height to be even smaller results in higher gain (The base thickness is not included in this absorption calculation and must be added as a constant term as discussed below.). Limiting the absorption of the x-rays at the step's maximum height to be less than $\approx 1/e^{0.6}$ does not appreciably increase the gain further. Reducing the maximum absorption at each step results in more Fresnel periods. Factors of 1.6 increase were calculated for the $1/e^{0.6}$ case over that of the 1/e embodiment. Thus, the gain doesn't vary rapidly with position and height, so that the step location and height is not too critical.

In some embodiments mechanical fabrication limitations may determine the minimum thickness of the lens and, hence, the step height. For example, lathe machining reproduction techniques of the Fresnel lens surface will limit the number and size of the steps. Present technology limits diamond turning to pitch angles, $\phi_p$, of the each Fresnel step to be approximately 20°, thus limiting the size and number of Fresnel steps. The pitch angle, $\phi_p$, is shown in FIG. 10.

6. Material Selection

In one of the embodiments of the present invention, inexpensive lenses are constructed using plastics. For the same total focal length and single lens shape (to maintain the same single lens shape for different materials requires a different number of lenses) the gain for the Be lens, for x-rays in the range from 1 to 30 keV, is about twice the value for $C_3H_6$. $C_3H_6$ appears to be the best plastic (i.e. better than polyethylene or Mylar) from the standpoint of gain, since it has the highest value for $\delta/\mu$. Similarly, the aperture for Be is approximately twice that of $C_3H_6$. However, plastics such as polyethylene are used to fabricate Fresnel lenses because of the ease of manufacturing. Polyethylene is easily injection molded into thin structures. This permits the preferred embodiment of thin Fresnel lenses with minimized x-ray absorption. Plastic Fresnel refractive lenses can be manufactured using existing Fresnel techniques of injection or compression molding. Unlike Be, plastic manufacturing using injection and compression molding is not highly toxic.

Plastic lenses permit mass manufacture of identical individual lens units, which can then be easily assembled into a compound refractive lens. Injection molding of plastic lenses is quick, efficient, and inexpensive. Thus large numbers of lens units can be fabricated. This permits large numbers of unit lens (larger N) for a compound refractive lens which in turn permits (1) shorter focal lengths, and (2) harder x-rays to be collected and focused.

In another embodiment using Be and other metals, individual Fresnel lenses can be machined using high-precision lathes. Besides being a better refractor and transmitter of x rays, Be has the higher heat conductivity. This permits higher x-ray fluxes to be transmitted by the compound refractive lens. Making lenses made of metal (such as Be) or other materials that are machined individually is very expensive. Hence, plastics should be utilized where x-ray beam power is low enough that the lenses survive over long periods. For high power applications, Be lenses would be optimum.

Figure 11D:
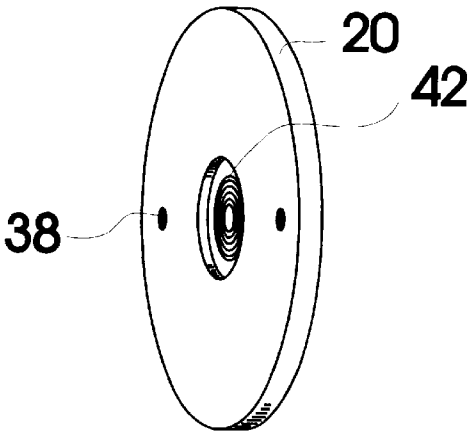
FIG. 11D shows an oblique view of the lens of FIG. 11A.
Figure 11C:
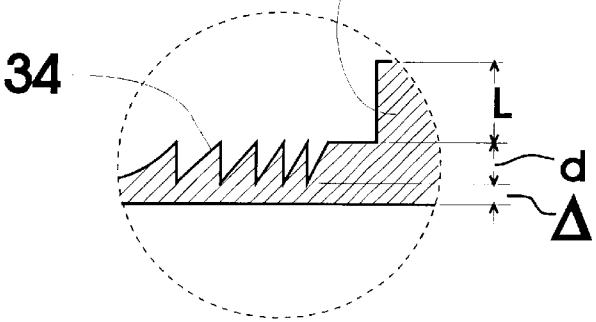
FIG. 11C shows a blown up view of the lens of FIG. 11B.
Figure 11B:
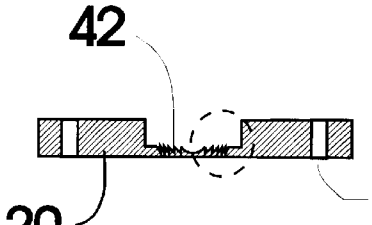
FIG. 11B shows the side view of the Fresnel lens of FIG. 11A.
Figure 11A:
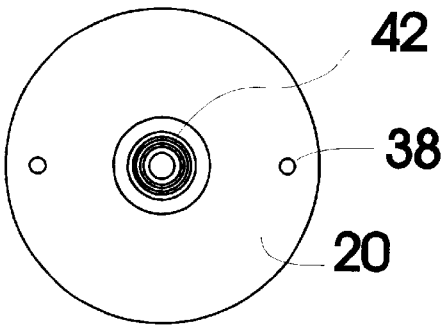
FIG. 11A shows the front view of a Fresnel lens contiguous with a support disk formed by compression or injection molding.

In another embodiment, a Fresnel lens may be made entirely out of one material. In one embodiment, the lens is made of plastic (e.g. high-density polyethylene). The entire Fresnel lens structure, shown in FIGS. 11A,B,C,&D, is fabricated out of plastic using injection molding. A front view of the Fresnel lens structure is shown in FIG. 11A. The Fresnel lens structure consists of the thin Fresnel lens 42 mounted inside a support disk 20. Alignment holes 38 are utilized as one method to align the multiple Fresnel lens structures. It is generally preferred to minimize the support material (Δ small) directly under the Fresnel surface.

To achieve thinner Fresnel lenses and reduce the lenses' overall absorption we again employ in another embodiment a thin plastic film 24 as shown in FIG. 12 to minimize the overall thickness of the unit lens. The thin film 24 supports the Fresnel lens 42 structure and permits the lens to be extremely thin. This permits the dimension Δ to be smaller. As in the case of the embodiment given in FIGS. 7 and 9, thin film 24 may be, for example, Mylar, Kapton (trade names of 3M Corp.) or thin films such as Boron or Silicon. Mylar was used in one embodiment (FIGS. 7A–7C). A metal disk 20 is used to align and support the lens. Compression molding and injection molding techniques can be used to form the lens on top of the Mylar substrate. Compression molding technique of FIG. 9 can also be used where the balls 28 are replaced by Fresnel lens dies. Mylar films that can support the Fresnel lens 42 structure can be as thin as 1.5 $\mu$m. Inexpensive thin films (e.g. Mylar and Kapton) are available in various sizes starting from 1.5 $\mu$m. These thin films are more durable than even metal films at these thicknesses, i.e. below approximately 10 microns.

Other methods may also be used to manufacture these new x-ray refractive lenses. For example, one can also utilize the techniques recently developed by researchers for the fabrication of miniature and micro-optics (visible-range optics). This includes electron beam writing in photoresist and laser writing in photoresist. The minimum blaze zone width that can be fabricated reliably with either technique is 2 to 3 microns. This permits even larger lens apertures. (These techniques are summarized in Handbook of Optics, Michael Bass editor in Chief, Chapter 7, McGraw Hill, 1995). Our analysis shown above demonstrates that optics that have the same tolerances for surface features of optical (visible) lenses can be utilized in the x-ray region of the spectrum. Thus these micro-optics techniques useful in the visible region can be used in the x-ray region.

7. Gain Calculation for Fresnel Lens

X-ray refractive lenses are different from optical lenses in that attenuation of the photon intensity passing through the lens is very important. In most applications, one would like to know that the intensity (power per unit area) of the x-ray photons increases with the use of the lens over the case where no lens is used. If one only had to account for focusing then it would always be true that the intensity of the x-rays would increase with the use of the lens. However, if the x-rays are being attenuated as they pass thorough the lens, then it is not apparent whether the intensity at the focal point will be necessarily larger with or without the CRL. Large amounts of attenuation will decrease the intensity at the focal point.

To define a useful parameter for determining the CRL's collection and focusing effectiveness, we define "Gain" as the ratio of the intensity at the focal point of the image plane when a CRL is in place to the intensity at the at the same point of the image plane when there is no CRL in place. The latter is equivalent to having an infinite aperture where the CRL would have been located. Thus, the Gain is $$G = \frac{I_{CRL}(0,0)}{I_{no-lens}(0,0)} \tag{50}$$

In this calculation the propagation of x-rays are predicted qualitatively by Huygens' principle and its precise mathematical form is provided by the Fresnel-Kirchhoff formula via Green's theorem. This treatment allows for the prediction of the electric field at any point in space where a wave propagates.

The denominator of equation (50) is the intensity at the focal point on the image plane from an incoherent circular source of radius $S_o$, emitting with wavenumber k when there is no CRL in place. This expression is found by solving the Fresnel-Kirchhoff formula for an infinitely large aperture placed at the plane where the CRL would have been located. Using the coordinate system depicted in FIG. 5A, the intensity with no lens yields $$I_{no-lens}(0,0) = 4\pi^3 K\left(\frac{fS_0}{k}\right) \tag{51}$$

where K is a constant and f is the focal length of the CRL given by the lens formula $$\frac{1}{f} = \frac{1}{r_o} + \frac{1}{r_i} \tag{52}$$

where $r_o$ is the object distance and $r_i$ is the image distance.

The numerator of equation (50) is the intensity at the focal point on the image plane, x=0, y=0, originating from the same source when the CRL is in place. The Fresnel-Kirchhoff formula yields intensity given by the following expression $$I_{CRL}(0,0) = 8K\pi^3\exp(-\mu_{base}Nd)\int_0^{s_0} r'dr' \left|\sum_{l=1}^{n-1}\exp\left\{\frac{(l-1)s}{2}\right\}\int_{r_{l-1}}^{r_l} r''dr''\exp\left(-\frac{\mu_{lens}r''^2}{4f\delta}\right)J_0\left(\frac{r'r''k}{r_0}\right)\right|^2 \tag{53}$$

where $\mu_{base}$ is the attenuation coefficient of the base material in each of the Fresnel lenses of the CRL (if a thin film 24 is used as in FIGS. 12A and 12B) and d is its thickness, $\mu_{lens}$ is the attenuation coefficient of the material forming each individual Fresnel lens of the CRL (Note $\mu_{base}=\mu_{lens}$ for the embodiment of FIGS. 11A–11C), N is the number of Fresnel lenses in the CRL, $$r_l = \sqrt{\frac{2lsf\delta}{\mu_{lens}}}$$

is the $l^{th}$ Fresnel radius of the lens, and δ is the increment of the index of refraction of the individual lens material. s is a factor for varying thickness of the lens to limit absorption (s can be varied to change the thickness of the lens to minimize the depth of the zones and maintain uniformity of absorption across the lens. In particular, the depth of the zones is kept small in order to be able to machine the mold for the individual lenses of the CRL). Thus, the Gain of the CRL is given by $$G = \frac{2\exp(-\mu_{base}Nd)\int_0^{S_0} r'dr'\left|\sum_{l=1}^{n-1}\exp\left\{\frac{(l-1)s}{2}\right\}\int_{r_{l-1}}^{r_1} r''dr''\exp\left(-\frac{\mu_{lens}r''^2}{4f\delta}\right)J_0\left(\frac{r'r''k}{r_o}\right)\right|^2}{\left(\frac{fS_0}{k}\right)^2} \quad (54)$$

In our designs, we utilized equation (54) to determine if CRLs using Fresnel lenses give adequate collection and focusing of the x-rays to warrant their use. A gain greater than one (G>1) indicated that the lens was effective as a collector and focusser of x-rays to increase x-ray intensity. Gain, it must be noted, is a function of both the lens parameters and the source parameters (source size and distance from the lens). Thus, in comparing gains for different lenses, one needs to utilize identical sources (same source size and distance).

8. Lens Design.

It will now be demonstrated that one can design x-ray lenses using simple analytic expressions. We have developed a sufficiently general algorithm that encompasses most of the new embodiments described above. These new embodiments include the following types of lenses: lenses with spherical surfaces, lenses with parabolic surfaces and lenses with Fresnel surfaces. These lenses can in turn have concave or convex shapes. These lenses can have identical or different surfaces on each side of the support membrane (e.g. the lenses can be bi-convex, bi-concave, bi-Fresnel or they can be plano-convex, plano-concave or plano-Fresnel.).

In order to obtain a rough design of the CRL, one needs only two eqns: the equation for the focal length (eqn. (3)) and eqn. (56) (below) for the transmission through the CRL. Given the lens' material constants, $\mu$ and $\delta$, and the desired focal length of the CRL, one can then design the individual lenses. Using eqn. (3):

$$N = \frac{R}{2f\delta}. \quad (55)$$

In the design of all the lenses listed above, this equation can be utilized. The factor "R/2" in the equation changes depending upon the lens' shape chosen. For a simple spherical or cylindrical lens, R is the radius of the cylinder, $R_h$, or sphere, $R_s$. For a parabolic lens, $R_p$ is radius of curvature at the vertex of the parabolic lens (or 2 $R_p$ is the Latus Rectum of the parabola) in the equation for the surface of the lens, $$2d = \frac{r^2}{R_p},$$

as given by eqn. (31). For the case of plano-convex or plano-concave lenses, the factor "R/2" become "R". The Fresnel lens curvature is usually parabolic.

In order to do a simple calculation of the lens parameters, one needs to limit the amount of x-ray absorption that occurs in the CRL. The x-ray absorption limits the number of lens that one can use. The fraction of transmission through the CRL is given approximately by:

$$T=\exp\{-\mu_{lens}d_{ave}-\mu_{base}\Delta\}N \quad (56)$$

where: $\mu_{lens}$ and $\mu_{base}$ are the linear absorption constants of the lens and the base, respectively; $\Delta$ is the thickness of the base support (see FIGS. 6B, 7A, 8A, 9A, 11C for $\Delta$) and dave is the average thickness of the each lens found in general from:

$$d_{ave} = \frac{\int_0^{R_e} s(r)dr}{R_e} \quad (57)$$

where s(r) is the individual lens thickness as a function of the radial variable. To minimize absorption we require that the transmission $T>e^{-2}$ (roughly 13.5% transmission) or:

$$N < \frac{2}{\mu_{lens}d_{ave} + \mu_{base}\Delta} \quad (58)$$

Using eqn. (44) the design of a lens is simple, given the desired focal length, one determines the radius R based on the following:

$$R=2Nf\delta \quad (59)$$

Eqns. (58) and (59) gives the maximum values for N and R, respectively. One can use these equations to calculate the lens shape based on the desired focal length and know material parameters of the individual lenses.

In most cases the average thickness of the lens is much smaller than that of the base, $\Delta$. Thus, to first order eqn. (58) becomes:

$$N < \frac{1}{\mu_{base}\Delta} \quad (60)$$

For a more accurate estimate, the average thickness, $d_{ave}$, of the lens can be obtained from the geometries of the various lens shapes by obtaining the average absorption across the individual lenses. In the following we calculate the $d_{ave}$ for three cases: Fresnel lens, parabolic lenses, and spherical lenses and their various types: plano concave, bi-concave. To determine the effectiveness of the lens in gathering x-rays and focusing them, one can use the gain equations given above for the Fresnel lens case and the gain equations as calculated by Snigirev for cylindrical lens. A gain greater than one (G>1) indicates that the lens is effective as a collector of x-rays. Gain, it must be noted again, is a function of both the lens parameters and the source parameters (source size and distance from the lens). Thus, in comparing gains for different lenses, one needs to utilize identical sources (same source size and distance).

9. Support and Alignment Structures

To stack the Fresnel lenses such that they form a compound refractive lens and achieve required alignment and support, numerous approaches are available. The following describes several specific embodiments.

Figure 13B:
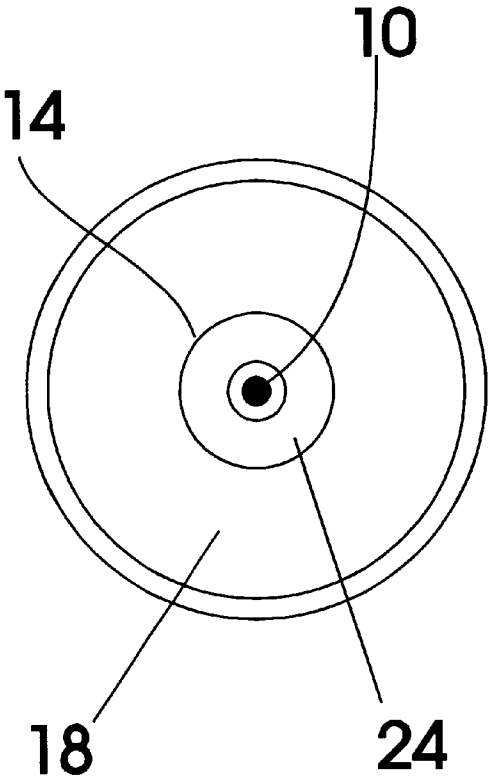
FIG. 13B shows the front view of a cylindrical support and alignment element for a compound refractive lens.
Figure 13A:
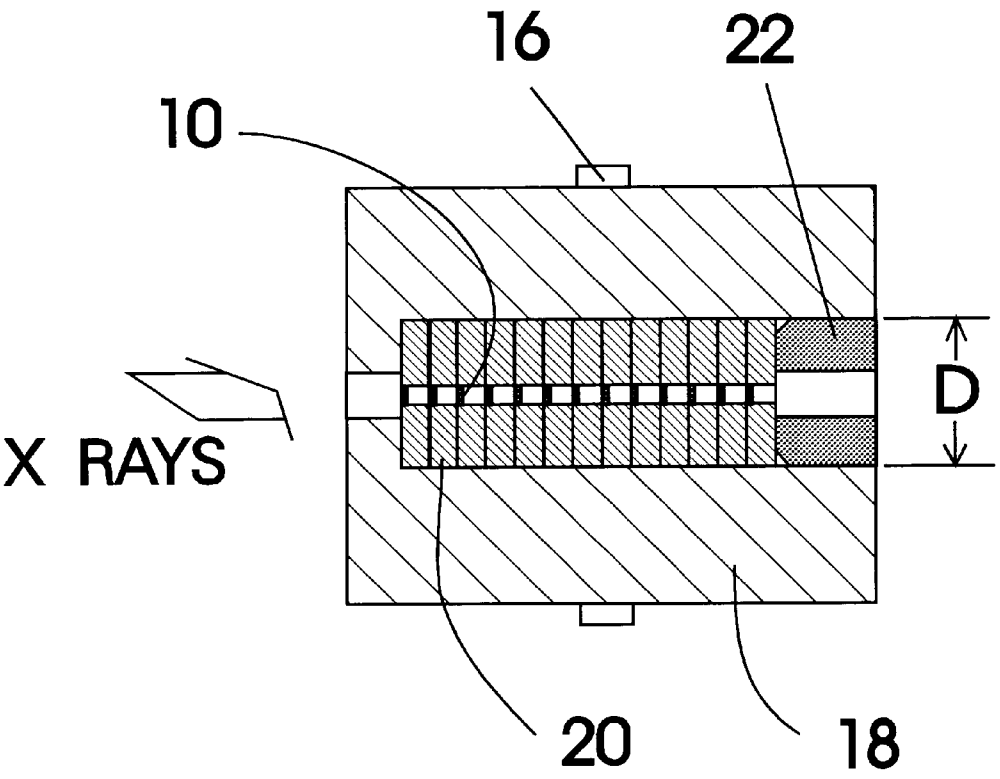
FIG. 13A shows the side view of a cylindrical support and alignment element for a compound refractive lens.

As is shown in FIG. 13., unit lenses are aligned by utilizing the disk shape of the unit lens support disk 20 by stacking them inside a support cylinder 18. Accuracy is achieved by machining the unit lens support disk's 20 diameter to be slightly less than the diameter of cylindrical hole 14 the support cylinder 18. Various embodiments for the unit lenses of FIGS. 6A, 7C, 8C, 9B, 11D and 12A may be aligned and supported by placing them inside this support cylinder 18 (This has been done using unit lenses of FIGS. 7C and 8C). FIG. 13 also shows a cross-sectional side view and an on-axis view of the support cylinder 18 containing multiple unit lenses 10 and their support disks 20. The support cylinder 18 consists of a cylindrical hole 14 whose diameter is slightly larger than the diameter D of the lens disk 20 or slightly larger than the ring supporting the individual lens element. Thus the support cylinder 18 is machined such that the unit lenses 10 and their support disks 20 can be slipped into the cylinder. A plug 22 is placed in the support cylinder 18 as a means to hold the lens/support disks 20 inside the support cylinder 18 and maintain the unit lens 10 and support disks 20 in alignment. Alignment accuracy of less than 25 $\mu$m can be easily achieved using this technique and still permit the lenses with unit lens 10 and support disks 20 to be slipped into the support cylinder 18. A support ring 16 can be part of the embodiment for use in supporting and aligning the entire structure in a laser gimbal mount. Those skilled in the art will understand that the exterior shape of support cylinder 18 is not significant. It merely serves as a housing for the cylindrical hole 14.

Figure 14:
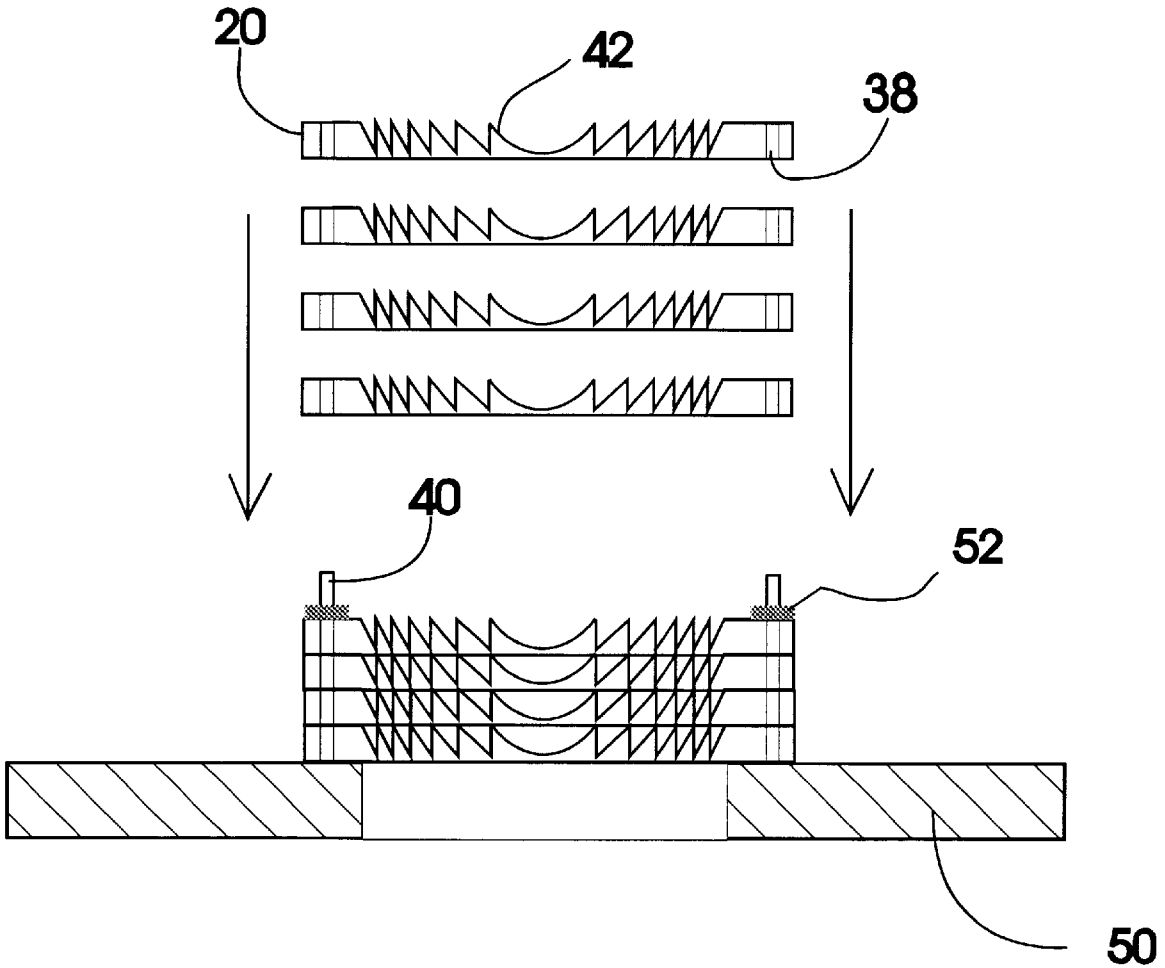
FIG. 14 shows a support and alignment elements for holding unit lenses.

Another method for holding the compound refractive lens structure is to utilize alignment holes 38 on the lens support disk 20. This embodiment is demonstrated in FIG. 14 and, also, in FIG. 3A and 3B. These alignment holes 38 are also shown in FIGS. 11A–11D, and 12A–12B. Unit lens support disks 20 shown in embodiments shown in FIGS. 6A, 7C, 8C and 9B can also have alignment holes placed in them. As shown in FIGS. 3 and 14, the unit lenses are placed on a metal support plate 50 that has two or more alignment rods 40 that match the spacing between the alignment holes 38 in support disks 20. The unit lenses are stacked on top of one another on the alignment rods 40 and secured to the post by a fastening element 52 (e.g. a hex nut). The alignment rod 40 can be mechanically threaded on the top end to accommodate a nut as a retainer.

Those skilled in the art will also understand that the shapes of the unit lens support disk 20 need not be cylindrical. For example, it could be rectangular when using the embodiment where there are alignment holes. Any convenient shape for the support disk 20 can be employed for the disk if alignment holes 38 are used.

In another embodiment, the unit lenses can be first aligned using a variety of optical and visual techniques to insure that the lenses are aligned to have a common optical axis. The lenses would then be held together by using an adhesive. This could eliminate the support cylinder 18 of FIG. 13 or the alignment rods 40 and metal support plate 50 of FIG. 14. The adhesive would be applied not directly to the lens itself but between the contiguous support disks 20. Other methods of adhering the unit lenses together such as epoxy or a metal bonding (spot welding) would also be possible. This technique would produce a rigid CRL structure capable of self-support and would facilitate mass production of CRLs.

9. Achromatic X-ray Lens Arrays.

Figure 15:
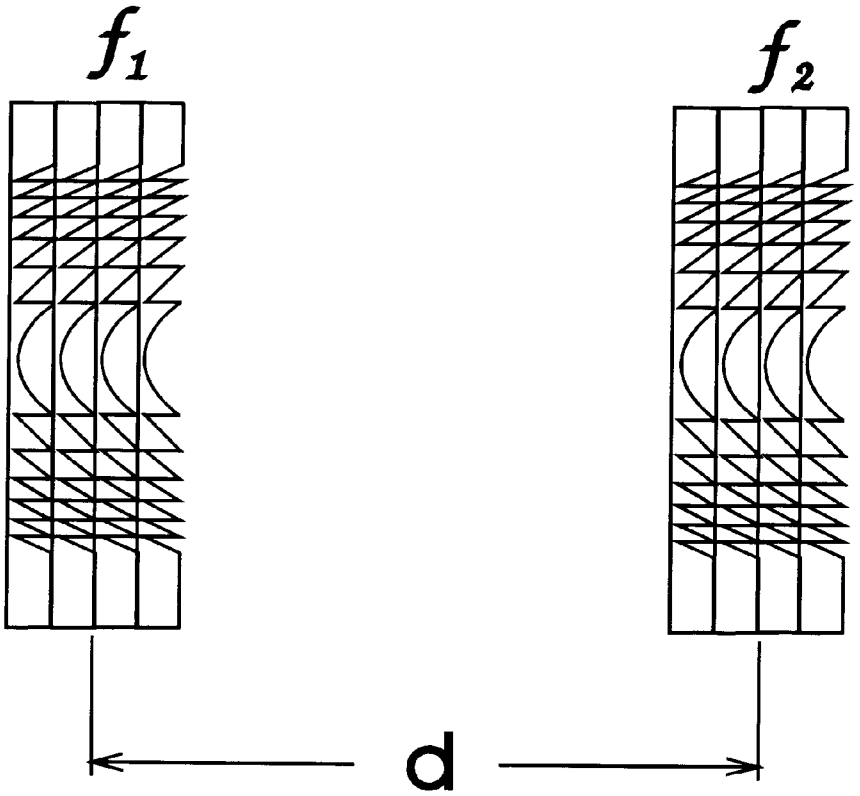
FIG. 15 shows two compound refractive lenses separated by an appropriate distance to make an achromatic lens system.

Another feature of the invention is that the x-ray CRLs are capable of having close to identical focal length over large variations in x-ray photon energy. This is achieved by placing the lenses an appropriate distance, d, apart as shown in FIG. 15. The x-ray lens arrays have focal lengths $f_1$ and $f_2$, respectively, and are separated by a distance d. The focal length f for the combined lens is given as $$\frac{1}{f} = \frac{1}{f_1} + \frac{1}{f_2} - \frac{d}{f_1 f_2} \tag{61}$$

Since for x-ray lenses the focal length is given by:

$$f_i = \frac{R}{2N_i\delta_i} \text{ and } \delta_i = \frac{\lambda^2}{2\lambda_{pi}^2} \tag{62}$$

where $\lambda_{pi}$=plasma wavelength. The wavelength dependence off is by substitution of eqn. (62) in to eqn. (61):

$$\frac{1}{f} = K_1\lambda^2 + K_2\lambda^2 - K_1K_2d\lambda^4 \tag{63}$$

with $$K_i = \frac{N_i}{R_i\lambda_{pi}^2} \tag{64}$$

one can compensate for chromatic aberration by setting f from eqn. (63) to the same value for the two different values of $\lambda$.(viz. $\lambda_a$ and $\lambda_b$). This yields the optimum distance for d:

$$d = \frac{K_1 + K_2}{K_1K_2(\lambda_a^2 + \lambda_b^2)} \tag{65}$$

where $\lambda_a$ and $\lambda_b$ are the two wavelengths. If the two lenses are identical ($K=K_1=K_2$) then $$d = \frac{2}{K(\lambda_a^2 + \lambda_b^2)} \tag{66}$$

or $$d=f_0(\lambda_0^2) \tag{67}$$

where $f_0=f_1=f_2$=focal length for one lens and $$\lambda_0^2 = \frac{\lambda_a^2 + \lambda_b^2}{2}. \tag{68}$$

As an example, consider two CRLs with identical focal lengths of 1.0 m at $\lambda$=1 Å (12.4 keV). This gives K=100 $\mu m^{-3}$. Let $\lambda_a$=2 Å and $\lambda_b$=1.8 Å, so that d=0.276 m. Then, $$f=[2\lambda^2-0.276\lambda^4]^{-1} \tag{69}$$

where $\lambda$ is measured in Å. From FIG. 16 it is seen that for the single lens there is ±10% variation in f over 10% bandwidth and ±20% variation over 20% bandwidth. For the achromatic lens (two lenses) there is ±0.9% variation over 10% bandwidth and ±2.5% variation over 20% bandwidth.

Thus in one embodiment, two identical lenses, separated by an appropriate distance, may be used to perform chromatic correction, For the example considered, over a 10% photon bandwidth the variation in focal length is reduced by a factor greater than 10 relative to the standard compound refractive x-ray lens.

10. Compound Lens Systems.

Both convergent and divergent lenses are also possible since one can use common optical (visible light) techniques for manufacturing small lenses. Such a variety of lens types permits the fabrication of x-ray devices that have optical (visible light) equivalents. For example, x-ray telescopes and microscopes are possible using simple optical analogies. A simple telescope and microscope can be formed by a concave and convex refractive lens system as shown in FIG. 16A and 16B. Two compound refractive lenses (x-ray plano-concave CRL 58 and x-ray plano-convex CRL 60) form the microscope or telescope in FIG. 16A. The optical (visible) equivalent is shown in FIG. 16B (plano-concave optical lens 56 and plano-convex optical lens 54). As stated before, such systems are possible due to the fact that one can manufacture individual unit lenses of complex shapes and stack them using common machine shop alignment techniques, injection molding or compression molding techniques to form optically equivalent lenses. This clearly is a major advance, and permits x-ray optical systems that are effectively equivalent to visible optical systems. Tolerances on the lens shapes are those of optical (visible light) lenses. Thus many optical techniques of manufacture such systems may be transferred directly to x-ray refractive lenses.

11. The Use of Higher Z-materials for Lens Fabrication

It is particularly advantageous to be able to utilize compound refractive lenses (CRLs) in the very hard x-ray region (E>15 keV) of the spectrum where grazing angle optics can not operate and where there are a number of medical, industrial, and other applications. Indeed, as far as we know, there are no optics available for photon energies above 30 keV. With the exception of mammography (which requires energies of 15 to 25 keV), most medical imaging applications require photon energies above 30 keV.

Yang concluded that lower the density materials (or lower Z) are best for all photon energies that can be reached by refractive optics. As discussed above, the Yang paper states that the best material possess a large $\delta/\beta$, where $\beta$ and $\delta$ are the factors in the complex dielectric constant as given by eqn. 2 (B. X. Yang "Fresnel and refractive lenses for X-rays", Nuclear Instruments and Methods in Physical Research A328 pp. 578–587 (1993)). However, designs that we have made show that the number of individual lenses required for such designs (using low Z materials such as Be) increase to the point where the CRL would become too long and its aspect ratio (total CRL length to aperture diameter) becomes very large. For example, the lowest density lens that would be practical would be made of Be. However, designs for Be lenses in the 30 keV to 100 keV range show that the number of lenses would be greater than 1000 for focal lengths of less than 1 meter.

Switching to designs of higher Z materials decreases the number of lenses (N<600) and makes the total length of the lens small enough for practical applications. Some examples are given in Table I below. In Table I, we have utilized high Z materials such as Au, W, and Cu. The Fresnel lenses can be supported on the same materials as the lens or lower Z-materials to reduce absoption. In the Table I examples, we have looked at designs where these high Z materials rest on substrates of Silicon Nitrate, Boron or on thin diamond films (these substrate materials have been utilized before for x-ray lithography masks). Our calculations show that utilizing Au, W, and Cu on these substrates using lithographic techniques to produce Fresnel lenses results in CRLs that can operate up to 100 keV with focal lengths of 30 cm.

TABLE I

Designs of CRLs using high-Z materials: For 100 keV photons

| Lens Material | f (cm) | # of lenses | Total Thick. ($\mu$m) | Diam. (mm) | # zones | Gain (2-D) | Transm. (2-D)% |
|---|---|---|---|---|---|---|---|
| Cu | 60 | 1400 | 2 | 0.74 | 580 | 535 | 74 |
| Au | 60 | 600 | 1.4 | 0.6 | 1070 | 7 | 13 |
| Au | 30 | 600 | 1.4 | 0.3 | 535 | 11 | 13 |
| W | 60 | 800 | 1.3 | 0.8 | 1660 | 8.3 | 14 |
| W | 30 | 800 | 1.3 | 0.4 | 829 | 15 | 14 |

12.K-, L- and M-edge Designs

The absorption of x-ray in materials changes dramatically above each of their various electron shell energies. These are the energies where photons are absorbed readily because they supply enough energy to cause transitions in either the K- L- or M-shells of the atoms of the material. At these edges, the absorption can change as much as a factor of 10. Below these photon energies, the absorption falls dramatically forming a transmission filter for the x-rays. Thus, designing these lenses at their material's respective K-, L- and M-edge photon energies can decrease the overall absorption of the x-rays in the lenses. This is demonstrated in Table IV for copper that has been deposited on a thin membrane such as Boron Nitrate. The edges for copper are 8.7 keV and 900 eV for the K- and L-edges respectively. The 8.7 keV lenses appear to be particularly interesting since the diameter of the lens is relatively large (when compared with polyethylene lens design) while the gain, transmission are all good.

TABLE II

Designs of CRLs using K or L-edge transmission (Copper example).

| Photon Energy (eV) | f (cm) | # of lenses | Total Thick. ($\mu$m) | Diam. (mm) | # zones | Gain (2-D) | Transm. (2-D)% | Edge |
|---|---|---|---|---|---|---|---|---|
| 8,700 | 60 | 40 | 2 | 2.5 | 2200 | 88 | 36 | K |
| 8,700 | 30 | 57 | 1.5 | 1.7 | 2200 | 92 | 36 | K |
| 8,700 | 10 | 100 | 1.3 | 1.1 | 2200 | 235 | 28 | K |
| 900 | 60 | 1 | 1.7 | 3 | 2200 | 9.4 | 21 | L |
| 900 | 10 | 1 | 1.7 | 0.5 | 495 | 11 | 21 | L |

Higher-Z materials permit even higher photon energies to be focused with high transmission (when compared to polyethylene). As shown in Table V, gold permit lenses be designed at 78.8 keV, while lenses made of Tungsten (shown in Table VI) can be designed at 68.8 keV. These lenses would be operational below this energy approximately 50% bandwidth below their respective K-edge energies. Note these designs permits the CRLs to have apertures larger than those designed at other photon energies.

TABLE III

Designs of CRLs using K, L, and M-edge transmission (Gold example).

| Photon Energy (eV) | f (cm) | # of lenses | Total Thick. ($\mu$m) | Diam. (mm) | # zones | Gain (2-D) | Transm. (2-D)% | Edge |
|---|---|---|---|---|---|---|---|---|
| 78.8 | 60 | 600 | 1.5 | 0.9 | 1287 | 58.2 | 36 | K |
| 78.8 | 30 | 600 | 1.5 | 0.5 | 643 | 103 | 36 | K |
| 10.1 | 30 | 30 | 1.3 | 1.4 | 1840 | 16 | 15 | L |
| 10.1 | 10 | 30 | 1.3 | 0.45 | 920 | 28 | 9 | L |
| 1.9 | 30 | 1 | 1.5 | 0.9 | 1350 | 6.3 | 34 | M |

TABLE IV

Design of CRLs using K, L, and M-edge transmission (Tungsten example)

| Photon Energy (eV) | f (cm) | # of lenses | Total Thick. ($\mu$m) | Diam. (mm) | # zones | Gain (2-D) | Transm. (2-D)% | Edge |
|---|---|---|---|---|---|---|---|---|
| 68.8 | 60 | 800 | 1.3 | 1.3 | 2200 | 65 | 37 | K |
| 68.8 | 30 | 900 | 1.3 | 0.9 | 2200 | 113 | 37 | K |
| 9.9 | 10 | 50 | 1.2 | 0.7 | 2200 | 40 | 16 | L |
| 1.7 | 60 | 1 | 1.4 | 1.4 | 2200 | 3.4 | 34 | M |
| 1.7 | 30 | 2 | 1.5 | 1.7 | 2200 | 5.6 | 14 | M |

13. Proof-of-Principle X-ray Lenses

We have fabricated and tested several lenses using ultra-thin unit lenses made of Mylar. These were manufactured using the compression molding technique on 25-$\mu$m Mylar film as outlined in above and shown in FIGS. 9A–C. The unit lenses were bi-concave and were manufactured using stainless steel spheres 3.18 mm in diameter, thus R=1.6 mm. The diameter of the lens made the ball was approximately 0.35 mm and the minimum thickness of the unit lens was $\Delta \approx 5\ \mu$m. The number of unit lenses was 198. We utilized the alignment and support technique for the unit lenses as demonstrated in FIGS. 3 and 14.

We also fabricated other lenses utilizing other technique outlined above and shown in FIGS. 6A through 8C. For brevity, the results of these lenses were not included here.

To test the CRLs we utilized beamline 2–3 on the Stanford Synchrotron Radiation Laboratory's (SSRL's) synchrotron. The experimental apparatus is shown in FIG. 18. The synchrotron x-ray source 70 was used to produce the x-rays that were defined in photon energy by a double crystal monochromator 62 and defined spatially by an entrance slit 66 at the entrance to the CRL 44. The distance from the synchrotron x-ray source 70 to CRL was $r_o$=16.81 meters. An ionization chamber 64 was used to detect the x-ray power. The x-ray beam was profiled using a translatable Ta slit 68. The slit 68 was translated across the focused x-ray beam (y and x-axis) and the current monitored from the ionization chamber 64. Since the ionization chamber 64 was downstream of the slit 68, it measured the x-ray power passing through them. The profile of the x-ray beam coming from the compound refractive lens (CRL) 44 was then obtained. We manually moved the translatable slits 68 along the z-axis of the x-ray beam measuring its vertical and horizontal width by scanning the slits over the beam at each location.

In this way we demonstrated the focusing of 8 keV x-rays. In FIG. 19 we show the vertical spot size of the 8 keV photons for 4 distances: 18, 54, 74 and 109 cm. The minimum waist of 35.5 $\mu$m is seen to be at an image distance, $r_i$, of 74 cm (distance from CRL 44 to translatable slits 68). We also obtained the horizontal profile of the focused x-ray beam. The measured beam size in microns, full-width-half-maximum (FWHM), is plotted as a function of distance from the lens in cm in FIG. 20. Both horizontal and vertical FWHM are shown. FIG. 20 shows that the waist of the x-ray beam is converging to two minimums for these two planes. Since source size ($\approx$0.445 by 1.7 mm$^2$) the focal spot size in the vertical (35.5 $\mu$m) and horizontal (78 $\mu$m) were not the same. Thus the CRL was clearly acting as a x-ray lens in that it was focusing the 8 keV x-rays.

These results clearly demonstrate two-dimensional focusing using a CRL composed of spherical lenses rather than crossed cylindrical CRLs (as was done in the prior art of A. Snigirev, B. Fiseth, P. Elleaume, Th. Klacke, V. Kohn, B. Lengeler, I. Snigireva, A. Souvorov, J. Tummler ("Refractive lenses for high energy X-ray focusing" SPIE vol. 3151, 1997).). This is the first demonstration of true two dimensional (2-D) focusing using lenses of revolution that are similar to lenses in the visible range. These 2-D unit lenses are thinner by a factor of 5 over the 1-D cylindrical unit lens of the prior art. The unit lenses do not have a common substrate, as does the prior art of Tomie and Snigeriv et al, but are individually prepared permitting complex lens surfaces to be fabricated such as the Fresnel surface. The reduction in thickness reduces absorption and widens the photon energy range of the CRL. Other major benefits of these lenses have enumerated above.

Variables Used in This Patent $R_s$ is the radius of curvature of a spherical lens $R_h$ is the radius of a hole $R_p$ is the radius of curvature at the vertex of the parabolic lens (or 2 $R_p$ is the Latus Rectum of the parabola)

n is the complex refractive index of the lens material $\delta$ is the refractive index decrement of the lens material $\mu$ is the linear absorption coefficient of the lens material $\mu_{lens}$ and $\mu_{base}$ are the linear absorption constants of the lens and the base materials f is the focal length of the CRL $f_1$ is the focal length of the unit lens $r_a$ is the absorption aperture radius $r_p$ is the parabolic aperture radius $r_e$ is the effective aperture radius $r_m$ is the lens mechanical aperture radius d is the thickness of the lens $d_{ave}$ is the average thickness of a unit lens 2d is the thickness of the bi-concave lens Δ is the minimum thickness of lens.

$r_i$ is the image distance (distance from lens to image)

$r_o$ is the object distance (distance from source to lens)

λ is the x-ray wavelength $t_i$ is the displacement of the ith lens orthogonal from the mean axis of the linear array of lenses as defined by $$\sum_{i=1}^{N} t_i = 0.$$

$y_i$ is the radial displacement of a single ray passing through the $i^{th}$ unit lens.

s(r) is the individual lens thickness as a function of the radial variable $\sigma_s$ is the standard deviation of the surface errors.

$\sigma_t$ is the standard deviation of the transverse off set of the unit lens from the mean axis of the linear array of lenses G is the gain of the lens $S_o$ incoherent circular source of radius

What is claimed is:

1. A compound refractive lens for x-rays, comprising:

a plurality of individual unit lenses comprising a total of N in number, said unit lenses hereinafter designated individually with numbers i=1 through N, said unit lenses substantially aligned along an axis, said i-th lens having a displacement $t_i$ orthogonal to said axis, with said axis located such that $$\sum_{i=1}^{N} t_i = 0,$$

and;

wherein each of said unit lenses comprises a lens material having a refractive index decrement δ<1 at a wavelength λ<100 Angstroms.

2. A compound refractive lens as in claim 1, wherein said displacements $t_i$ are distributed such that there is a standard deviation $\sigma_t$ of said displacements $t_i$ about said axis, and wherein each of said unit lenses is a spherical lens and has an absorption aperture radius $r_a$, a mechanical aperture radius $r_m$, a radius of curvature $R_s$, and a minimum effective aperture radius $r_e$=MIN($r_a$,$r_m$), such that $\sigma_t$ is less than $r_e$ and also less than $R_s/2$.

3. A compound refractive lens as in claim 1 wherein said displacements $t_i$ are distributed such that there is a standard deviation $\sigma_t$ of said displacements $t_i$ about said axis, and wherein each of said unit lenses is a parabolic lens, and has an absorption aperture radius $r_a$, a mechanical aperture radius $r_m$, and a minimum effective aperture radius $r_e$=MIN ($r_a$,$r_m$), such that $\sigma_t$ is less than $r_e$.

4. A compound refractive lens as in claim 1 wherein said displacements $t_i$ are distributed such that there is a standard deviation $\sigma_t$ of said displacements $t_i$ about said axis, and wherein each of said unit lenses is a Fresnel refractive lens having a mechanical aperture radius $r_m$ such that $\sigma_t$ is less than $r_m$.

5. A compound refractive lens as in claim 2, wherein said spherical lens has a radius of curvature of $R_s$ and is made of material having a linear absorption coefficient $\mu$, and wherein said absorption radius $$r_a = \left(\frac{2R_s}{\mu N}\right)^{1/2}$$

if the said spherical lens is bi-concave or said absorption aperture radius $$r_a = \left(\frac{2R_s}{\mu N}\right)^{1/2}$$

if said spherical lens is plano-concave.

6. A compound refractive lens as in claim 3, wherein said parabolic lens has a latus rectum of $2R_p$ and is made of material having a linear absorption coefficient $\mu$, and wherein said absorption radius $$r_a = \left(\frac{2R_p}{\mu N}\right)^{1/2},$$

if the said parabolic lens is bi-concave, or said absorption aperture radius $$r_a = \left(\frac{R_p}{\mu N}\right)^{1/2},$$

if said parabolic lens is plano-concave.

7. A compound refractive lens according to any one of claims 2, 3, or 4 wherein $\lambda/4\sqrt{N}\delta \leqq \sigma_t < r_e$.

8. A compound refractive lens according to any one of claims 1, 2, 3, 4, 5, or 6 wherein each of said unit lenses has an average thickness $d_{ave}$ such that $d_{ave} << 1N\mu$.

9. A compound refractive lens according to claim 8, wherein $d_{ave} \leqq 25\ \mu m$.

10. A compound refractive lens according to any of claims 1, 2, 3, 4, 5, or 6, wherein said unit lenses are fabricated separately and do not have a common substrate.

11. A compound refractive lens according to any of claims 1 through 6 wherein each of the unit lenses is selected from a group of lenses consisting of a plano-concave lens, a bi-concave lens, a plano-convex lens, a bi-convex lens, and a Fresnel lens.

12. A compound refractive lens according to any of claims 1 through 6 wherein the plurality of the unit lenses are cylindrical and focus in one dimension.

13. A compound refractive lens according to any of claims 1 through 6 wherein the plurality of the unit lenses have a round or rectangular mechanical aperture and focus in two dimensions.

14. A compound refractive lens according to any of claims 1, 2, 3, 4, 5, or 6 wherein each unit lens is rigidified by a thicker contiguous support structure.

15. A compound refractive lens according to any of claims 1, 2, 3, 4, 5, or 6 wherein the unit lenses are made using injection or compression molding manufacturing techniques.

16. A compound refractive lens according to any of claims 1, 2, 3, 4, 5, or 6 wherein the unit lens structure shape is fabricated on top of and supported by a thin plastic film and by a contiguous structure which supports and rigidifies the unit lens.

17. A compound refractive lens according to any of claims 1, 2, or 3 wherein the unit lens structure shape is fabricated by molding the lens using spherical shaping means such as stainless steel ball or balls or a parabolic shaping means supported by a contiguous structure which supports and rigidifies the lens.

18. A compound refractive lens according to any of claims 1, 2, or 3 wherein the unit lens structure shape is fabricated in a thin metal substrate utilizing spherical shaping tool such as a ball end mill, or a parabolic shaping tool.

19. A compound refractive lens according to any of claims 1, or 4 wherein the plurality of thin unit lenses have refractive Fresnel shapes, are made of plastic and are of a single material.

20. A compound refractive lens according to any one of claims 1, or 4 wherein the plurality of thin unit lenses have refractive Fresnel shapes, are made of plastic, are of a single material, and supported and rigidified by thicker contiguous support structure.

21. A compound refractive lens according to any one of claims 1, or 4 wherein the plurality of thin unit lenses have refractive a Fresnel shape wherein said Fresnel shape fabricated on or in a thin support film by lithographic techniques or compression molding techniques; and whereas said thin support film is supported and rigidified by thicker contiguous support structure.

22. A compound refractive lens according to any one of claims 1, or 4 wherein the plurality of thin unit lenses have a refractive Fresnel shape that are fabricated by compression or injection molding techniques wherein said compression and injection molding techniques include utilizing molds fabricated using diamond lathe turning or lithographic techniques.

23. A compound refractive lens according to any one of claims 1, 2, 3, 4, 5, or 6 wherein the unit lenses are held by a cylindrical alignment and support element whereby the lenses have an average optical axis.

24. A compound refractive lens according to any one of claims 1, 2, 3, 4, 5, or 6 wherein the unit lenses are held and aligned by two or more alignment pins or rods whereby the lenses have an average optical axis.

25. A compound refractive lens according to any one of claims 1, 2, 3, 4, 5, or 6, wherein the unit lenses are aligned with an alignment means and then held together using an adhesive, an epoxy, a metal bonding means or any other fastening means.

26. A compound refractive lens according to any one of claims 1, 2, 3, 4, 5, or 6, further comprising the number of lenses, N, arranged as a succession of elements to form a compound refractive lens, the individual lenses being constructed of a material having atomic weight A, an atomic number Z, and a density $\rho \geqq 3$ gm/cm$^3$.

27. A compound refractive lens according to any one of claims 1, 2, 3, 4, 5, or 6, further comprising the number of lenses, N, arranged as a succession of elements to form a compound refractive lens, wherein $N \leqq 1/\mu(\omega_k)d$, where d is the minimum thickness of the individual lenses; $\mu(\omega)$ is the linear absorption coefficient of the lens material at frequency $\omega_k$, where $\omega_k$ is the K-shell, L-shell or M-shell photoabsorption edge frequency of the lens material.

28. A compound refractive lens system composed of lenses manufactured as described in claims 1, 2, 3, 4, 5, or 6 forming an achromatic x-ray lens, a telescope, a microscope or lens systems for the manipulation and use of x-rays.

29. A plurality of compound refractive lens composed of lenses manufactured as described in claims 1, 2, 3, 4, 5, or 6 whose focal lengths and separation are adjusted such that the focal length of the entire lens system is the same over a wide range of x-ray photon energies that is greater than any of the individual compound refractive lenses that compose the lens system.

30. A compound refractive lens as in claim 4, wherein $\sigma_t$ less than the smallest zone $(r_m - r_{m-1})$.

* * * * *